US010719030B2

(12) United States Patent
Hayashida et al.

(10) Patent No.: US 10,719,030 B2
(45) Date of Patent: Jul. 21, 2020

(54) MANUFACTURING METHOD OF CARTRIDGE AND CARTRIDGE

(71) Applicant: CANON KABUSHIKI KAISHA, Tokyo (JP)

(72) Inventors: Makoto Hayashida, Numazu (JP); Tetsuya Numata, Suntou-gun (JP); Naoki Maeda, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/360,413

(22) Filed: Mar. 21, 2019

(65) Prior Publication Data

US 2019/0302643 A1 Oct. 3, 2019

(30) Foreign Application Priority Data

Mar. 27, 2018 (JP) ..... 2018-060013

(51) Int. Cl.
*G03G 15/08* (2006.01)
*G03G 21/16* (2006.01)

(52) U.S. Cl.
CPC ..... *G03G 15/0812* (2013.01); *G03G 21/1647* (2013.01); *G03G 21/1676* (2013.01)

(58) Field of Classification Search
CPC ..... G03G 15/0812; G03G 21/1647; G03G 21/1676
See application file for complete search history.

(56) References Cited

U.S. PATENT DOCUMENTS 5,768,669 A * 6/1998 Yokoyama ..... B29C 65/56 156/73.1
6,326,821 B1 * 12/2001 Gabara ..... H03K 19/00384 326/85
8,081,898 B2 12/2011 Batori et al.
2005/0180779 A1 * 8/2005 Okamoto ..... G03G 15/0812 399/222

FOREIGN PATENT DOCUMENTS

JP S6335030 B2 7/1988
JP H0619374 A 1/1994
JP 4986948 B2 7/2012
JP 6132196 B2 5/2017

* cited by examiner

*Primary Examiner* — Gregory H Curran
(74) *Attorney, Agent, or Firm* — Rossi, Kimms & McDowell LLP

(57) ABSTRACT

A manufacturing method of a cartridge, the cartridge having a frame; a blade member fixed to the frame; a rotating member; and a bearing member for supporting the rotating member, the manufacturing method including: attaching the rotating member to the bearing member; fitting an adjustment shaft provided at the frame with an adjustment hole provided at the bearing member; adjusting a relative position of the bearing member with respect to the frame in a crossing direction crossing the rotational axial direction; and welding the frame and the bearing member after the adjusting, wherein at least one of the frame or the bearing member is melted such that a melted portion is formed between an inner peripheral surface of the adjustment hole and the adjustment shaft in the crossing direction.

20 Claims, 25 Drawing Sheets

MANUFACTURING METHOD OF CARTRIDGE AND CARTRIDGE

BACKGROUND OF THE INVENTION

Field of the Invention

The present invention relates to a manufacturing method of a cartridge, and a cartridge.

Description of the Related Art

In the related art, with an electrophotographic image forming apparatus (which will be also hereinafter simply referred to as an "image forming apparatus"), in order to facilitate toner replenishment and maintenance, a photosensitive drum, a charging means, a development means, a cleaning means, and the like are gathered in a frame to be formed into a cartridge. As a cleaning means, a cleaning blade coming in contact with the photosensitive drum in the counter direction with respect to the rotation direction thereof is used. As the fixing means for the cleaning blade onto the frame, fastening by a screw is used. For the development means, a development roller as a developer bearing member, and a development blade as a developer regulating member are used.

Positioning and fixing of a drum bearing for pivotally supporting the photosensitive drum, and a cleaning frame are performed by fitting the positioning shaft provided at the drum bearing with the positioning hole provided at the cleaning frame, further followed by fastening by a screw, resin bonding, or the like. This determines the relative positions of the photosensitive drum pivotally supported by the drum bearing, and the cleaning blade fixed to the cleaning frame. The relative positions of the photosensitive drum and the cleaning blade are set so that the cleaning blade penetrates into the surface of the photosensitive drum. As a result, the cleaning blade is contacted therewith under a predetermined pressure. This enables removal of the untransferred toner on the photosensitive drum.

The positioning and fixing of a development roller bearing for pivotally supporting a development roller and a developer container are also performed by the same configuration as that for the drum bearing (Japanese Patent No. 4986948). Positioning and fixing of the development roller bearing and the developer container determine the relative positions of the development roller pivotally supported by the development roller bearing, and the development blade fixed at the developer container. By setting the relative positions of the development roller and the development blade so that the development blade penetrates into the surface of the development roller, the development blade is contacted therewith under a predetermined pressure. This can regulate the toner on the surface of the development roller. On the other hand, in order to suppress the relative misregistration due to the processing error of the developer container or the development roller bearing, the following configuration has been proposed: while setting the positioning hole for the development roller bearing and the developer container as a slotted hole, screw fastening is performed with a sheet-like positioning jig inserted between the development roller and the developer container (Japanese Patent No. 6132196).

When positioning of the drum bearing with respect to the cleaning frame is performed by fitting of a round hole, the relative positions of the photosensitive drum and the cleaning blade may deviate from a predetermined amount according to the processing error of the cleaning frame or the drum bearing. Whereas, when positioning of the development roller bearing with respect to the developer container is performed by fitting of a round hole, the relative positions of the development roller and the development blade may deviate from a predetermined amount according to the processing error of the developer container or the development roller bearing.

Further, when fixing is achieved by a screw while performing positioning of the development roller bearing by slotted hole fitting and a sheet-like positioning jig, twisting torque due to screw fastening acts on the development roller bearing. The twisting torque deforms the development roller bearing, so that the relative positions of the development roller and the development blade after screw fastening may deviate from a predetermined amount.

When the relative positions of the photosensitive drum and the cleaning blade deviate from a predetermined amount, a variation in the contact pressure on the photosensitive drum by the cleaning blade increases. As a result, the untransferred toner on the photosensitive drum is undesirably removed insufficiently. Whereas, when the relative positions of the development roller and the development blade deviate from a predetermined amount, a variation in contact pressure on the development roller by the development blade increases. As a result, the layer thickness of the developer on the development roller undesirably ceases to be properly regulated.

SUMMARY OF THE INVENTION

It is an object of the present invention to suppress a variation in relative positions of the photosensitive drum and the cleaning blade and a variation in relative positions of the development roller and the development blade caused by the processing error of the components, and the assembly error due to the twisting torque upon screw fastening.

In order to achieve the object described above, a manufacturing method of a cartridge, the cartridge including a frame; a blade member including a leading end portion and fixed to the frame; a rotating member including a surface facing the leading end portion; and a bearing member for supporting the rotating member, the manufacturing method comprising:

attaching the rotating member to the bearing member;

fitting an adjustment shaft provided at the frame with an adjustment hole provided at the bearing member;

adjusting a relative position of the bearing member with respect to the frame in a crossing direction crossing a rotational axial direction of the rotating member; and welding the frame and the bearing member after the adjusting, wherein at least one of the frame or the bearing member is melted such that a melted portion is formed between an inner peripheral surface of the adjustment hole and the adjustment shaft in the crossing direction.

Further, in order to achieve the object described above, a cartridge, comprising:

a frame including a shaft;

a blade member including a leading end portion and fixed to the frame;

a rotating member including a surface facing the leading end portion of the blade member; and a bearing member for supporting the rotating member, and including a hole to be fitted with the shaft;

wherein the frame and the bearing member are welded such that a melted portion is formed between an inner peripheral surface of the hole and the shaft in a crossing direction crossing a rotational axial direction of the rotating member.

Further features of the present invention will become apparent from the following description of exemplary embodiments with reference to the attached drawings.

DESCRIPTION OF THE EMBODIMENTS

Below, embodiments of the present invention will be illustrated by reference to the accompanying drawings. However, the dimensions, materials, and shapes, of the constituent components described in embodiments, relative layout thereof, and the like should be appropriately changed according to the configuration and various conditions of the apparatus to which the invention is applied, and the scope of this invention is not construed as being limited to the following embodiments.

Embodiment 1

Below, a manufacturing method of a cartridge, and a cartridge in accordance with Embodiment 1 will be described in details by reference to the accompanying drawings. Incidentally, in Embodiment 1, the rotational axial direction of an electrophotography photosensitive drum is referred to as the longitudinal direction. Further, in the longitudinal direction, the side on which the electrophotography photosensitive drum receives a driving force from the image forming apparatus main body is referred to as a driving side, and the opposite side is referred to as a non-driving side. Whereas, a given cross section orthogonal to the longitudinal direction is referred to as a transverse cross section.

Figure 2:
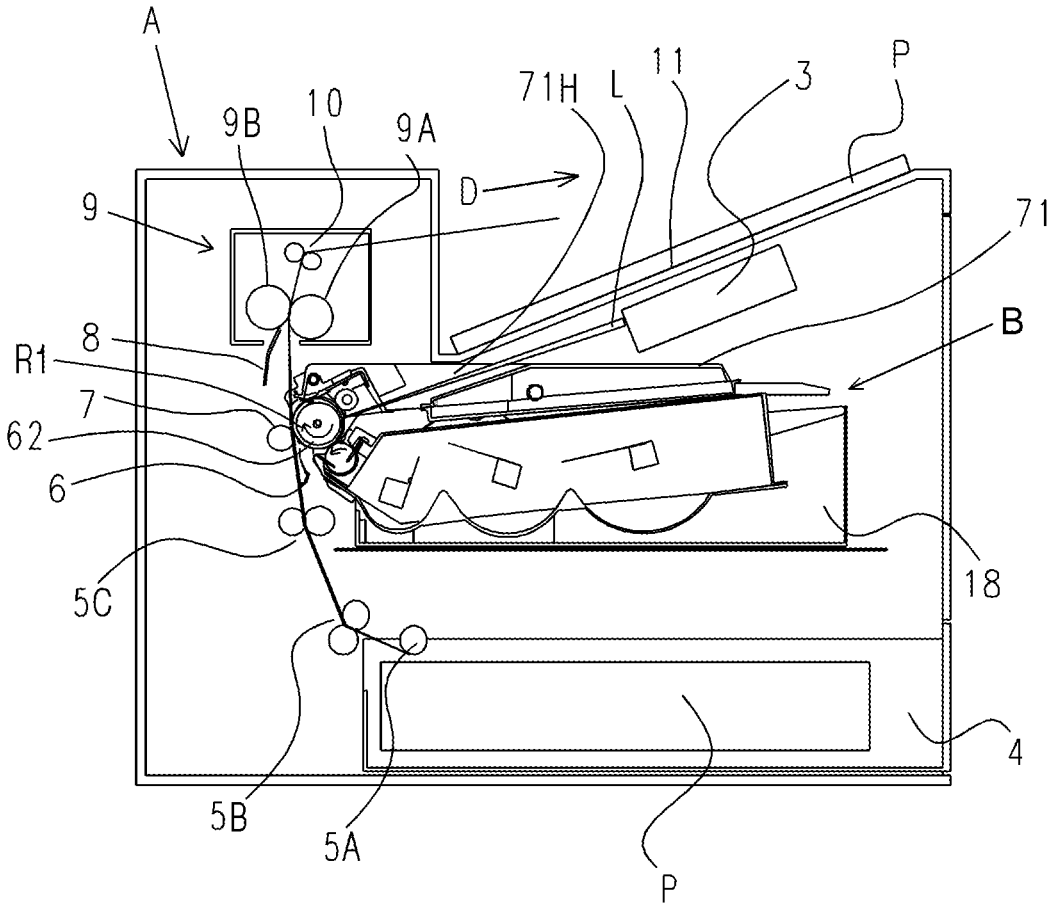
FIG. 2 is a cross sectional view of an image forming apparatus in First Embodiment.
Figure 3:
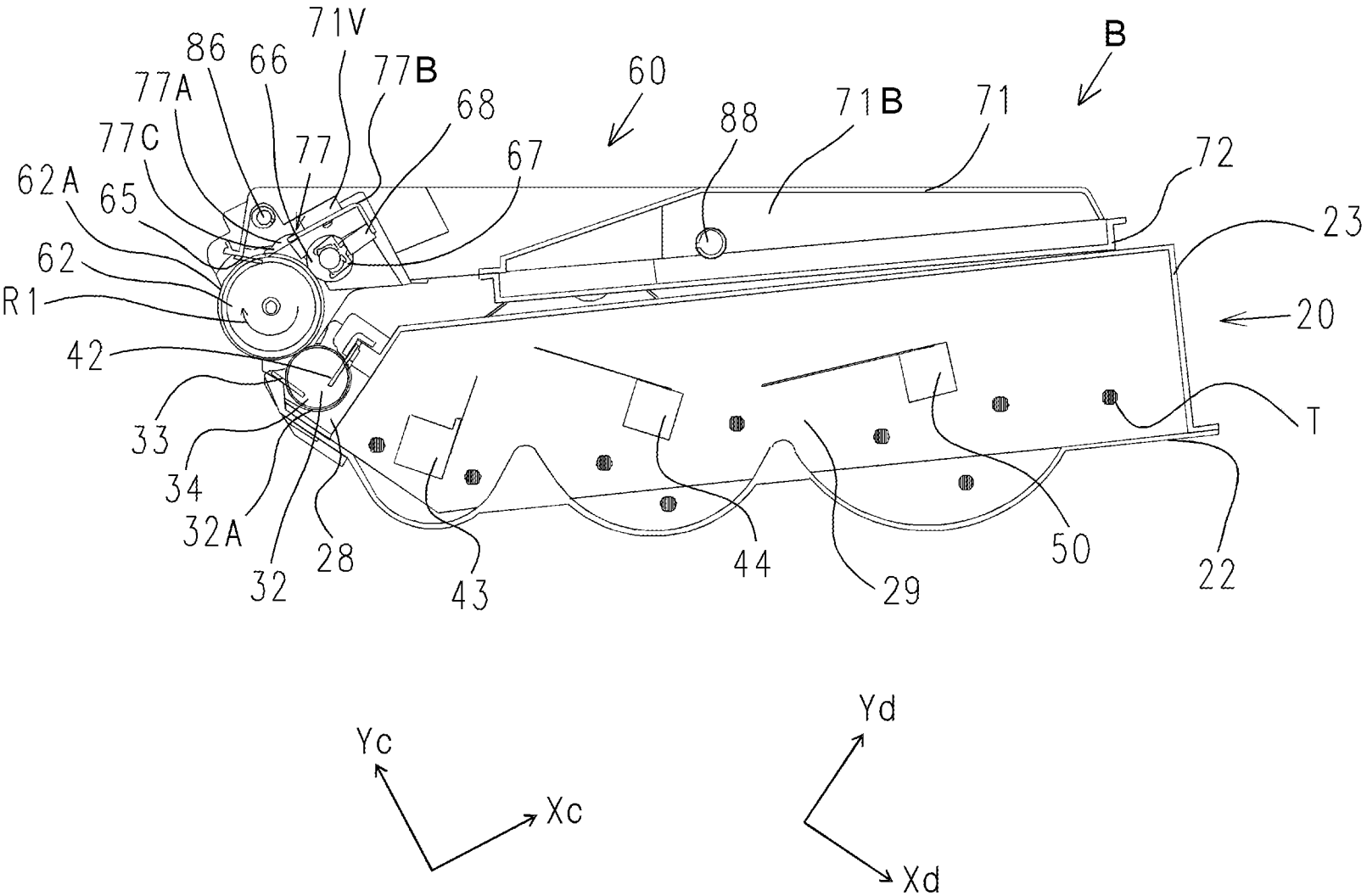
FIG. 3 is a cross sectional view of a process cartridge in First Embodiment.

By reference to FIGS. 2 and 3, the overall configuration and the image forming process will be described. FIG. 2 is a cross sectional view of an image forming apparatus main body (which will be hereinafter described as a main body A) and a process cartridge (which will be hereinafter described as a cartridge B) of an electrophotographic image forming apparatus in accordance with Embodiment 1. FIG. 3 is a cross sectional view of the cartridge B in accordance with Embodiment 1. Herein, the apparatus main body A is the portion of the electrophotographic image forming apparatus except for the cartridge B.

Overall Configuration of Electrophotographic Image Forming Apparatus

The electrophotographic image forming apparatus illustrated in FIG. 2 is a laser beam printer with the cartridge B detachably mounted in the apparatus main body A using an electrophotography technology. When the cartridge B is mounted in the apparatus main body A, in the electrophotographic image forming apparatus, an exposure apparatus 3 (laser scanner unit) for forming an electrostatic latent image on the electrophotography photosensitive drum (which will be hereinafter described as a drum 62) as the image bearing member of the cartridge B is disposed. Whereas, a sheet tray 4 accommodating a recording medium (which will be hereinafter described as a sheet material P) to be an image formation object therein is disposed on the lower side of the cartridge B. As the sheet materials P, mention may be made of recording paper, plastic sheet, and the like. Further, in the apparatus main body A, a pickup roller 5A, a feed roller pair 5B, a conveyance roller pair 5C, a transfer guide 6, a transfer roller 7, a conveyance guide 8, a fixing apparatus 9, a discharge roller pair 10, a discharge tray 11, and the like are successively disposed along the conveying direction D of the sheet material P. Incidentally, the fixing apparatus 9 includes a heat roller 9A and a pressure roller 9B.

Image Formation Process

Then, the outline of the image formation process will be described. When an image process is carried out, first, in response to a print start signal, a drum 62 is rotationally driven in a drum rotation direction R1 at a predetermined circumferential speed (process speed). The drum 62 is one example of the rotating member. A charging roller 66 applied with a bias voltage comes in contact with a drum outer peripheral surface 62A as the surface part of the drum 62, and charges the drum outer peripheral surface 62A uniformly and evenly. The exposure apparatus 3 outputs a laser light L according to image information. The laser light L passes through a laser opening 71H provided in a cleaning frame 71 of the cartridge B, and subjects the drum outer peripheral surface 62A to scanning exposure. As a result, an electrostatic latent image according to the image information is formed at the drum outer peripheral surface 62A.

On the other hand, as illustrated in FIG. 3, in a development unit 20 as a developing apparatus, the toner (developer) T in a toner chamber 29 is stirred and conveyed by the rotation of a first conveying member 43, a second conveying member 44, and a third conveying member 50, to be fed to a toner supply chamber 28. The toner T is held at the development roller outer peripheral surface 32A as the surface part of the development roller 32 by the magnetic force of a magnet roller 34 (stationary magnet). In this manner, the first conveying member 43, the second conveying member 44, and the third conveying member 50 convey the toner T toward the development roller 32. The development roller 32 is one example of the developer bearing member. The toner T is regulated on the layer thickness on the development roller outer peripheral surface 32A while being triboelectrically charged by a development blade 42. The development blade 42 is one example of the thickness regulating member. The toner T is developed on the drum 62 according to the electrostatic latent image, and is formed into a visible image as a toner image.

Further, as illustrated in FIG. 2, in time to the output timing of the laser light L, the sheet material P accommodated in the lower part of the apparatus main body A is fed from the sheet tray 4 by the pickup roller 5A, the feed roller pair 5B, and the conveyance roller pair 5C. Then, the sheet material P is conveyed through the transfer guide 6 to the transfer position between the drum 62 and the transfer roller 7. At the transfer position, the toner image is successively transferred from the drum 62 to the sheet material P.

The sheet material P on which the toner image has been transferred is separated from the drum 62, and is conveyed along the conveyance guide 8 to the fixing apparatus 9. Then, the sheet material P passes through the nip part between the heat roller 9A and the pressure roller 9B forming the fixing apparatus 9. At the nip part, a pressurizing/heat fixing treatment is performed, so that the toner image is fixed on the sheet material P. The sheet material P subjected to a fixing treatment of the toner image is conveyed to the discharge roller pair 10, and is discharged to the discharge tray 11.

On the other hand, as illustrated in FIG. 3, the residual toner on the drum outer peripheral surface 62A is removed by the cleaning blade 77 as a blade member, and the drum 62 after transfer is used for an image formation process again. In this manner, the toner on the drum 62 is cleaned by the cleaning blade 77. The cleaning blade 77 is one example of the cleaning member. The toner (removed substance) removed from the drum 62 is stored in a waste toner chamber 71B of a cleaning unit 60. In the above description, the charging roller 66, the development roller 32, the transfer roller 7, and the cleaning blade 77 are process means acting on the drum 62.

Cartridge Attaching and Detaching

Figure 5:
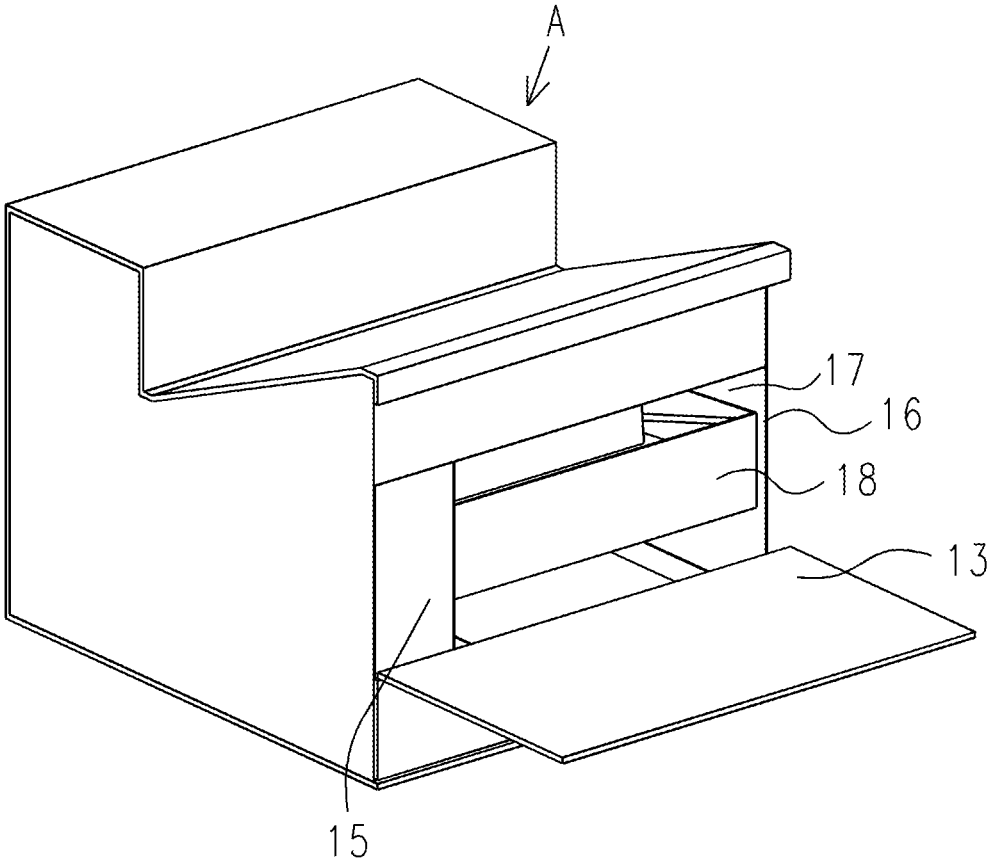
FIG. 5 is a perspective view of the image forming apparatus with the opening/closing door opened in First Embodiment.
Figure 6:
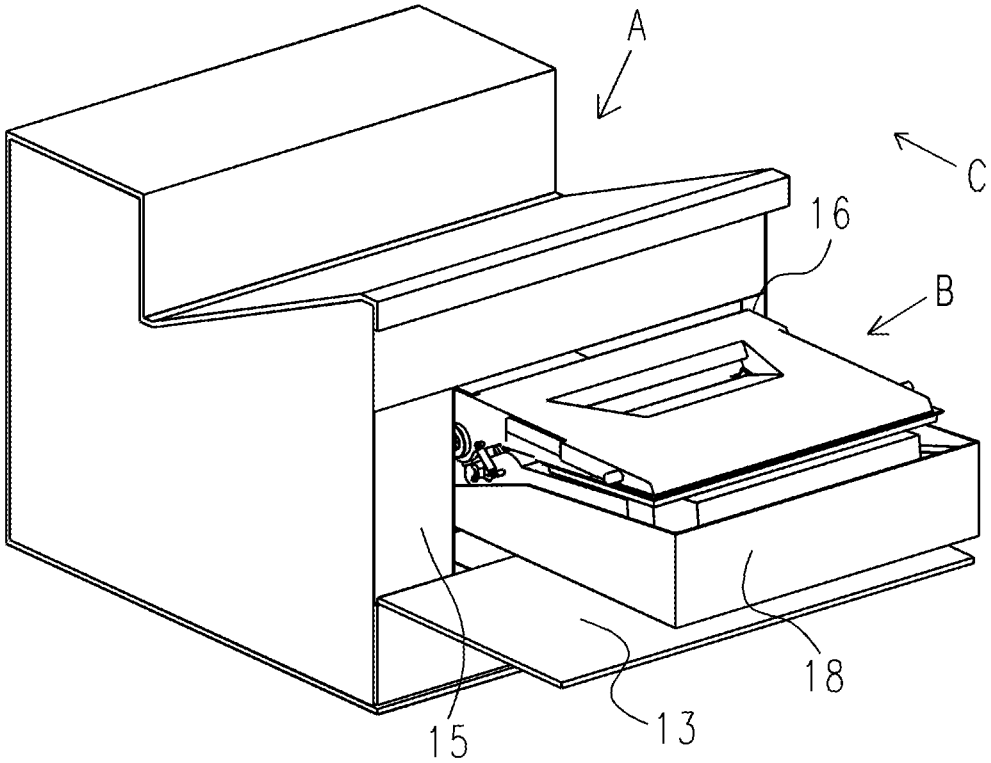
FIG. 6 is a perspective view of the image forming apparatus with a tray pulled out in First Embodiment.
Figure 7:
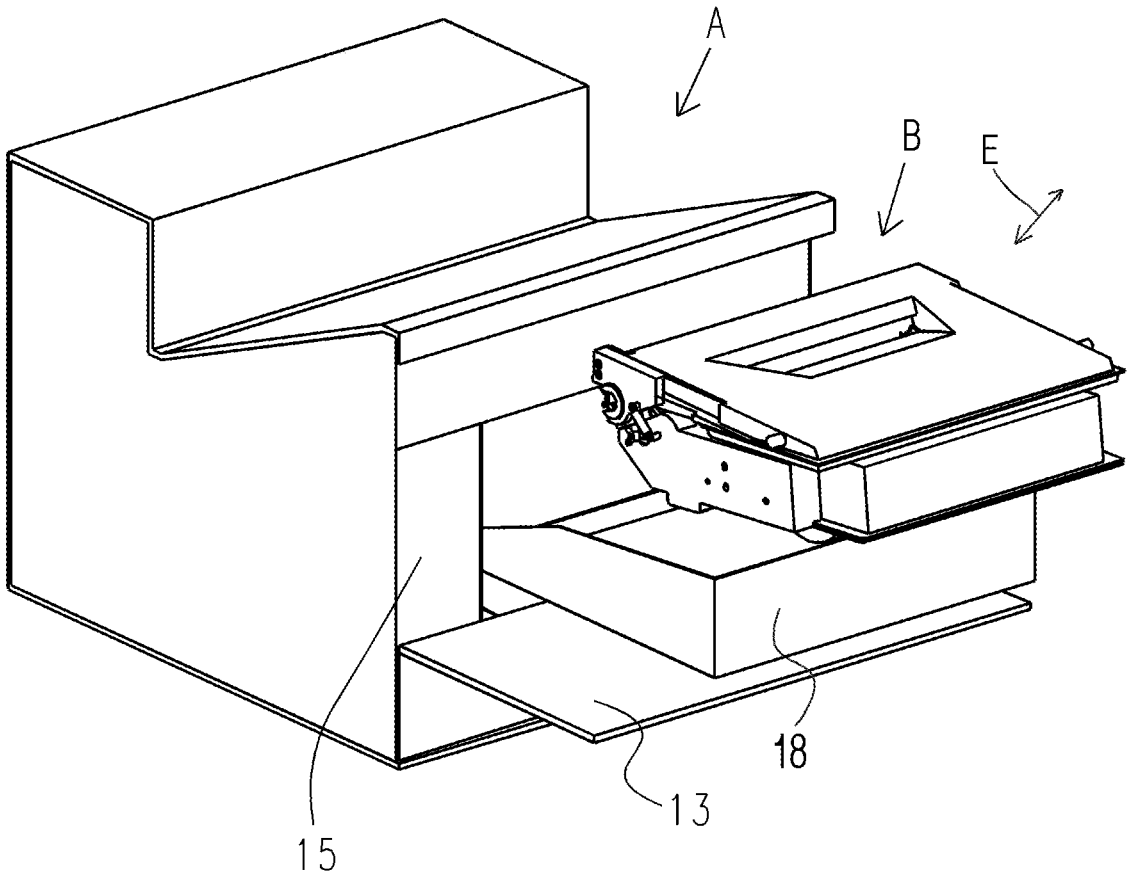
FIG. 7 is a perspective view when the process cartridge in First Embodiment is mounted or demounted.
Figure 8:
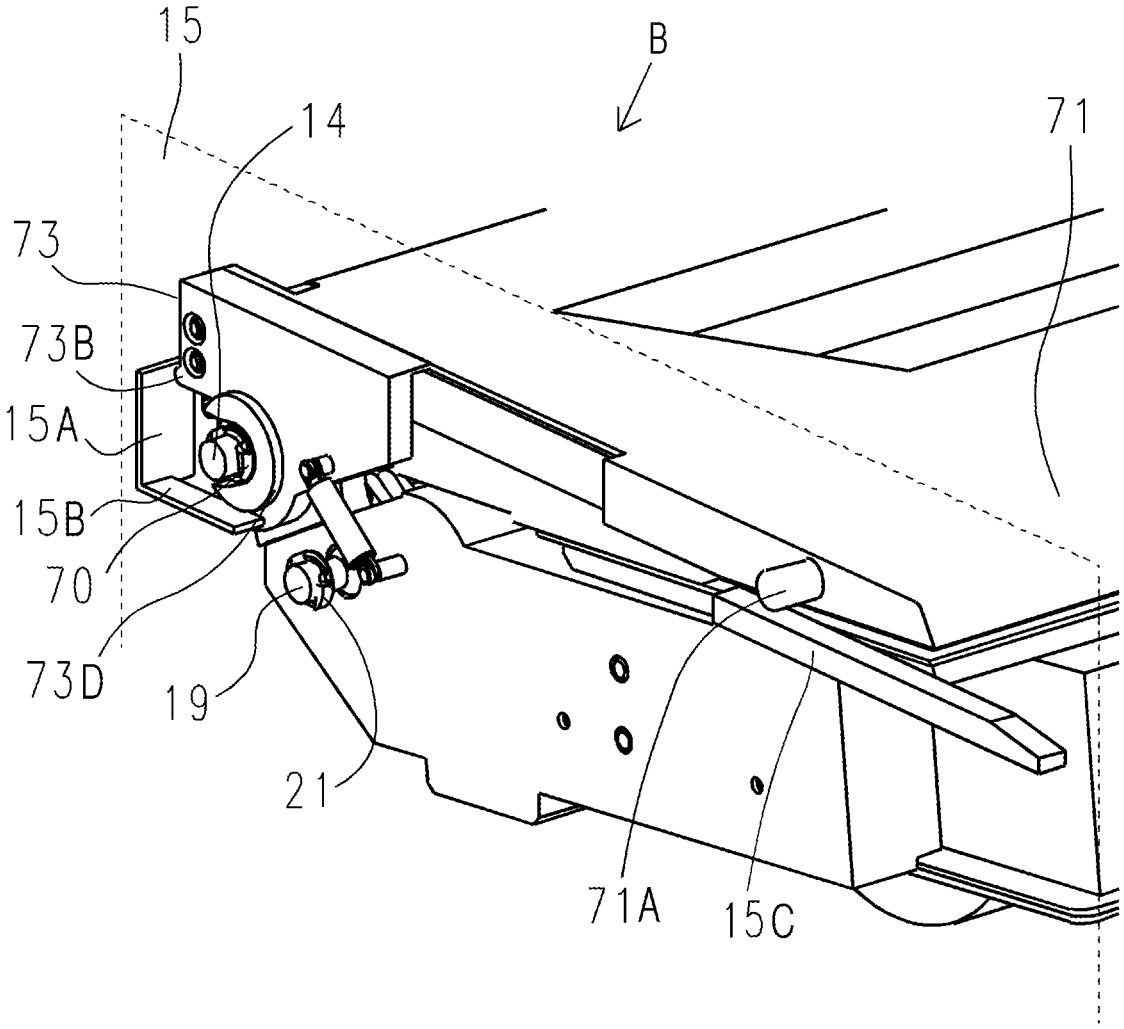
FIG. 8 is a perspective view of a driving side positioning part of the process cartridge in First Embodiment.

Then, attaching and detaching of the cartridge B with respect to the apparatus main body A will be described by reference to FIGS. 5, 6, 7, and 8. FIG. 5 is a perspective view of the apparatus main body A with the opening/closing door 13 opened for attaching and detaching the cartridge B. FIG. 6 is a perspective view of the apparatus main body A with the opening/closing door 13 opened and with the tray 18 pulled out for attaching and detaching the cartridge B, and the cartridge B. FIG. 7 is a perspective view of the apparatus main body A and the cartridge B when the cartridge B is attached or detached with the opening/closing door 13 opened, and the tray 18 pulled out. FIG. 8 is a perspective view of the driving side positioning part of the cartridge B. As illustrated in FIG. 7, the cartridge B is detachable along the attaching/detaching direction E with respect to the tray 18.

As illustrated in FIG. 5, the opening closing door 13 is attached rotatably to the apparatus main body A. Opening the opening/closing door 13 leads to a cartridge insertion port 17 provided therein. Then, in the cartridge insertion port 17, a tray 18 for attaching the cartridge B to the apparatus main body A is provided. When the tray 18 is pulled out to a predetermined position from the apparatus main body A, the cartridge B can be attached and detached. As illustrated in FIG. 6, the cartridge B is attached into the apparatus main body A along a guide rail (not illustrated) in the direction of an arrow C in the drawing while being put on the tray 18.

As illustrated in FIG. 8, a driving side sheet 15 of the apparatus main body A is provided with a first driving shaft 14 and a second driving shaft 19 for transmitting drive to a first coupling 70 and a second coupling 21 provided at the cartridge B, respectively. The first driving shaft 14 and the second driving shaft 19 are driven by a motor (not illustrated) of the apparatus main body A. As a result, the drum 62 connected with the first coupling 70 is rotated in response to a driving force from the apparatus main body A. Further, the development roller 32 is rotated in response to transmission of a drive from the second coupling 21. Furthermore, the charging roller 66 and the development roller 32 are fed with power from a feeding part (not illustrated) of the apparatus main body A.

Cartridge Support

Figure 9:
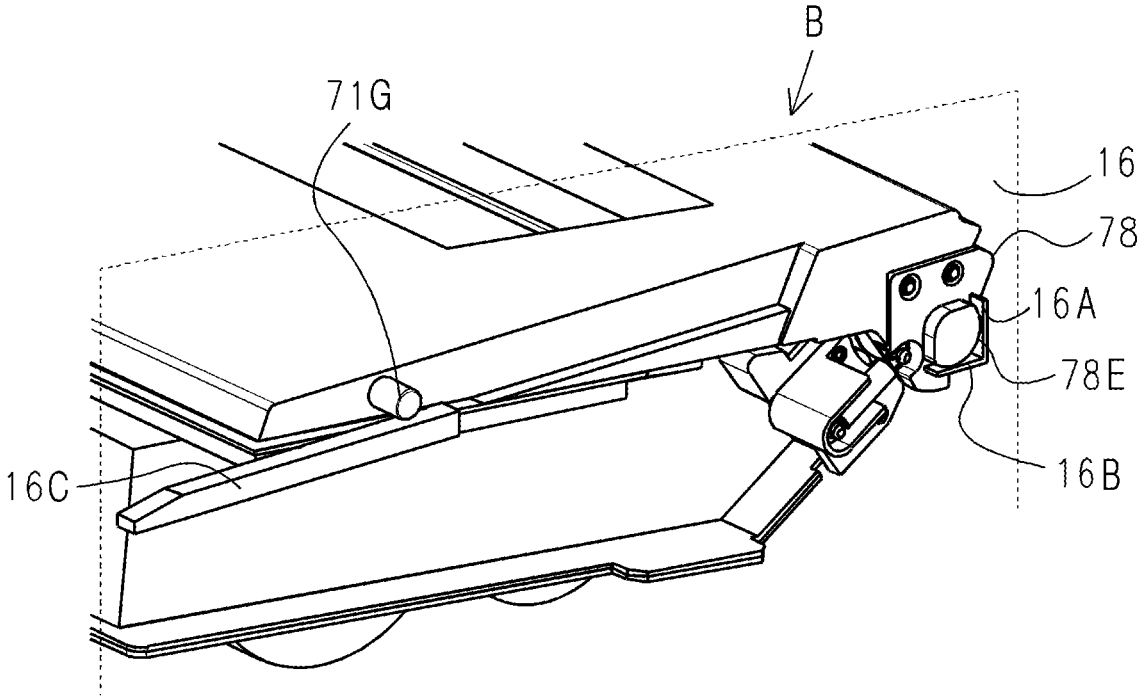
FIG. 9 is a perspective view of a non-driving side positioning part of the process cartridge in First Embodiment.

As illustrated in FIG. 5, the apparatus main body A is provided with the driving side sheet 15 and the non-driving side sheet 16 for supporting the cartridge B. As illustrated in FIG. 8, the driving side sheet 15 is provided with a first support portion 15A, a second support portion 15B, and a rotary support portion 15C. As illustrated in FIG. 9, the non-driving side sheet 16 is provided with a first support portion 16A, a second support portion 16B, and a rotary support portion 16C.

On the other hand, a first to-be-supported part 73B and a second to-be-supported part 73D of the driving side drum bearing 73, a driving side boss 71A and a non-driving side boss 71G of the cleaning frame 71, and a projecting part 78E of the non-driving side drum bearing 78 are respectively provided at the cartridge B. Then, the first to-be-supported part 73B is supported by the first support portion 15A, the second to-be-supported part 73D is supported by the second support portion 15B, and the driving side boss 71A is supported by the rotary support portion 15C. Further, the projecting part 78E is supported by the first support portion 16A and the second support portion 16B, and the non-driving side boss 71G is supported by the rotary support portion 16C. As a result, the cartridge B is positioned in the apparatus main body A.

Configuration of Whole Cartridge

Figure 4A:
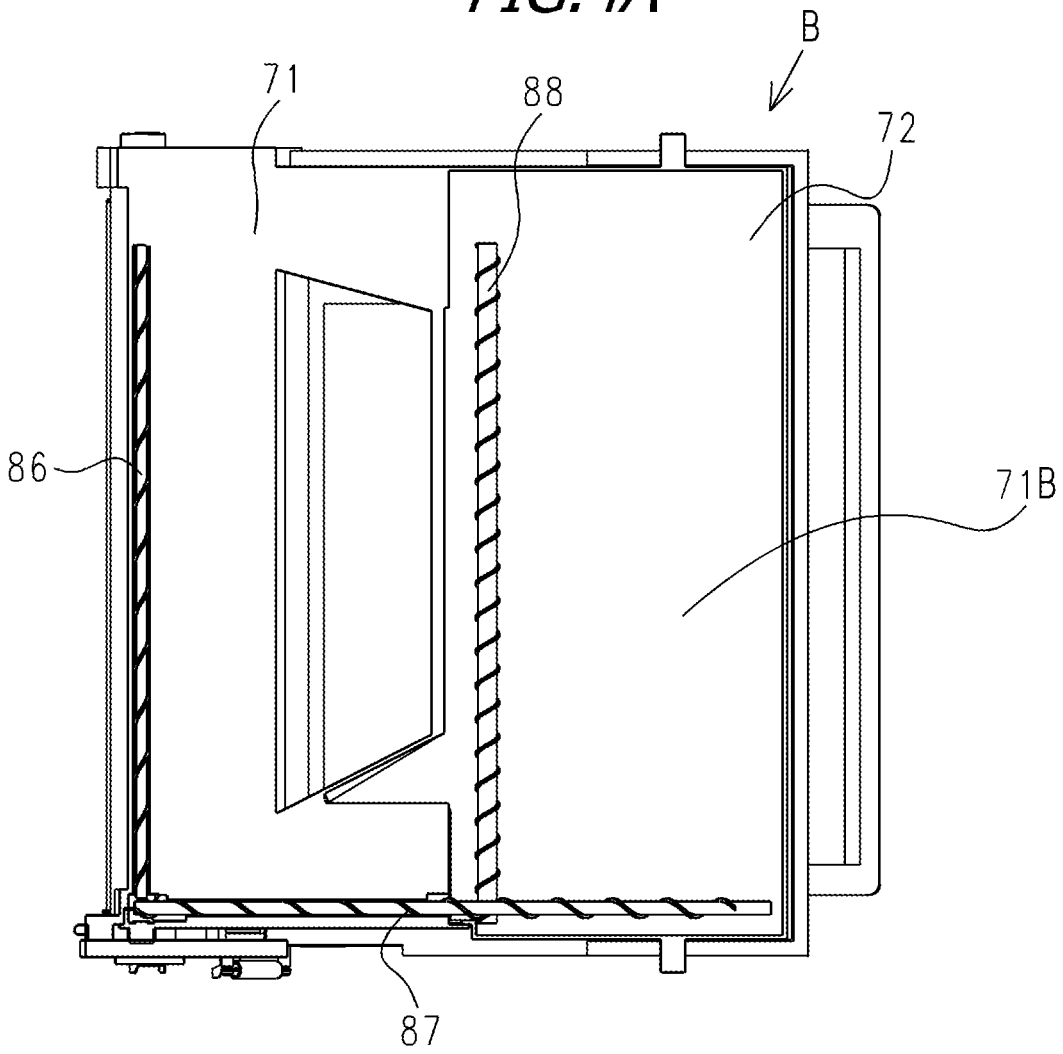
FIGS. 4A and 4B are each a cross sectional view of the inside of a cleaning container in First Embodiment.
Figure 4B:
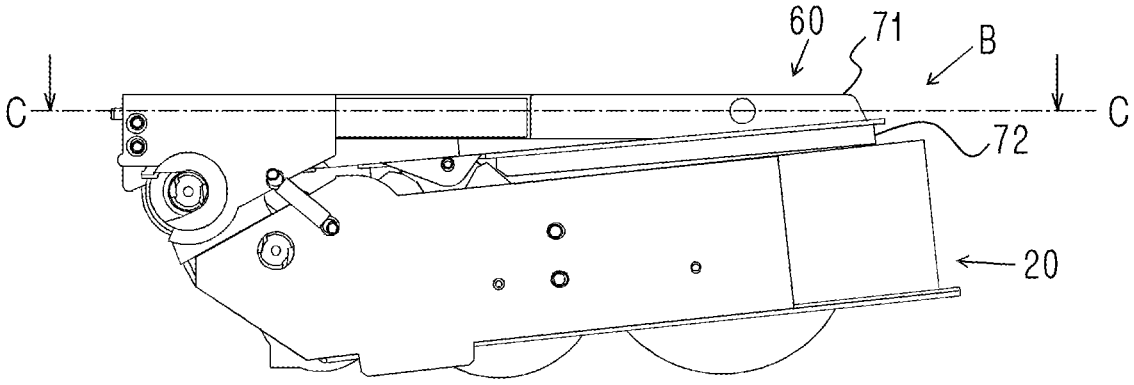

Then, the overall configuration of the cartridge B will be described by reference to FIGS. 3, 4A, 4B, 10, 11, 12, and 13. FIG. 3 is a transverse cross sectional view of the cartridge B, FIG. 4A is a longitudinal cross sectional view of the cleaning frame 71, and FIG. 4B is a transverse cross sectional view of the cartridge B. FIG. 4A illustrates a cross section along an alternate long and short dash line C-C of FIG. 4B. FIGS. 10, 11, 12, and 13 are each an exploded perspective view for illustrating the configuration of the cartridge B. FIGS. 11 and 13 are partially enlarged views illustrating the parts in dotted lines of FIGS. 10 and 12 as viewed from different angles, respectively.

As illustrated in FIG. 3, the cartridge B has the cleaning unit 60 and the development unit 20. Incidentally, the process cartridge is formed in the following manner: an electrophotographic photosensitive member, and at least one of a charging means, a development means and a cleaning means as process means acting thereon are integrated into a cartridge, which is detachably mounted in the main body of the electrophotographic image forming apparatus. In the present invention, the process cartridge has at least one of the cleaning unit 60 and the development unit 20.

Figure 10:
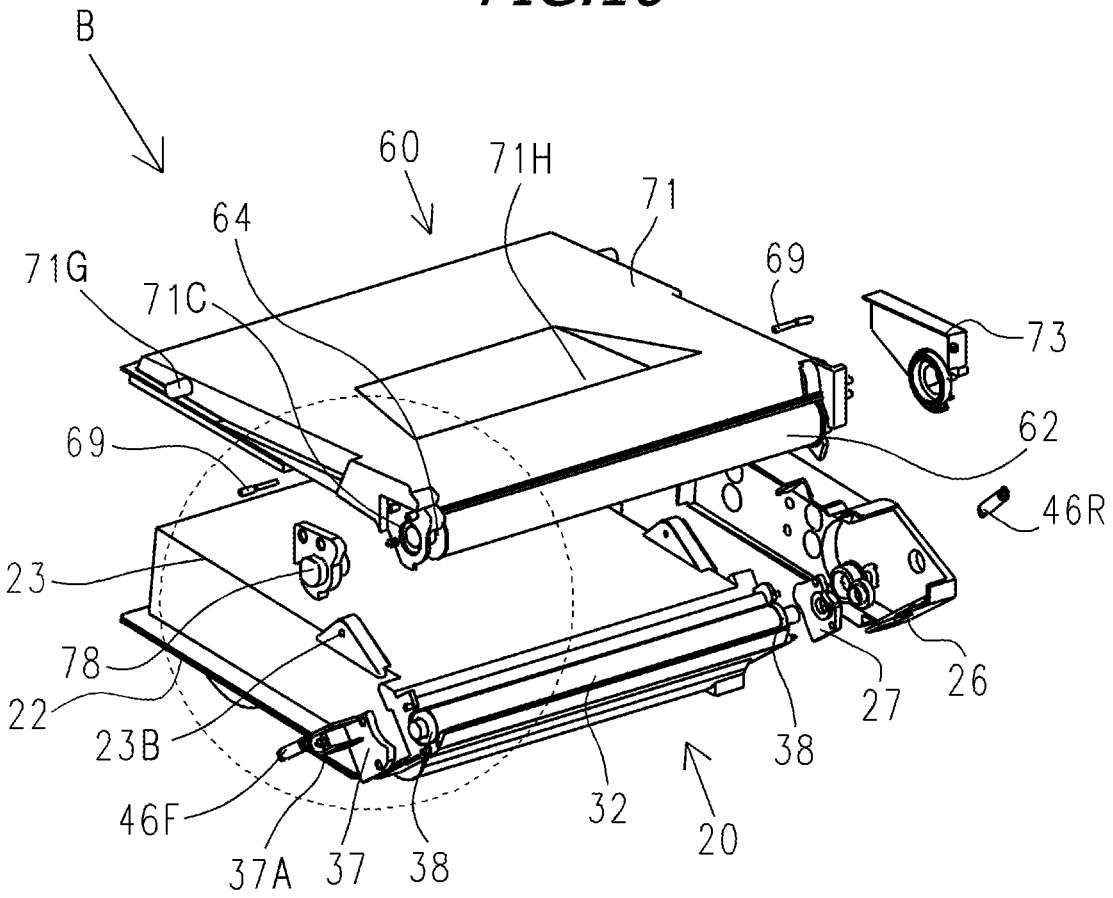
FIG. 10 is a perspective view of the process cartridge in First Embodiment.
Figure 11:
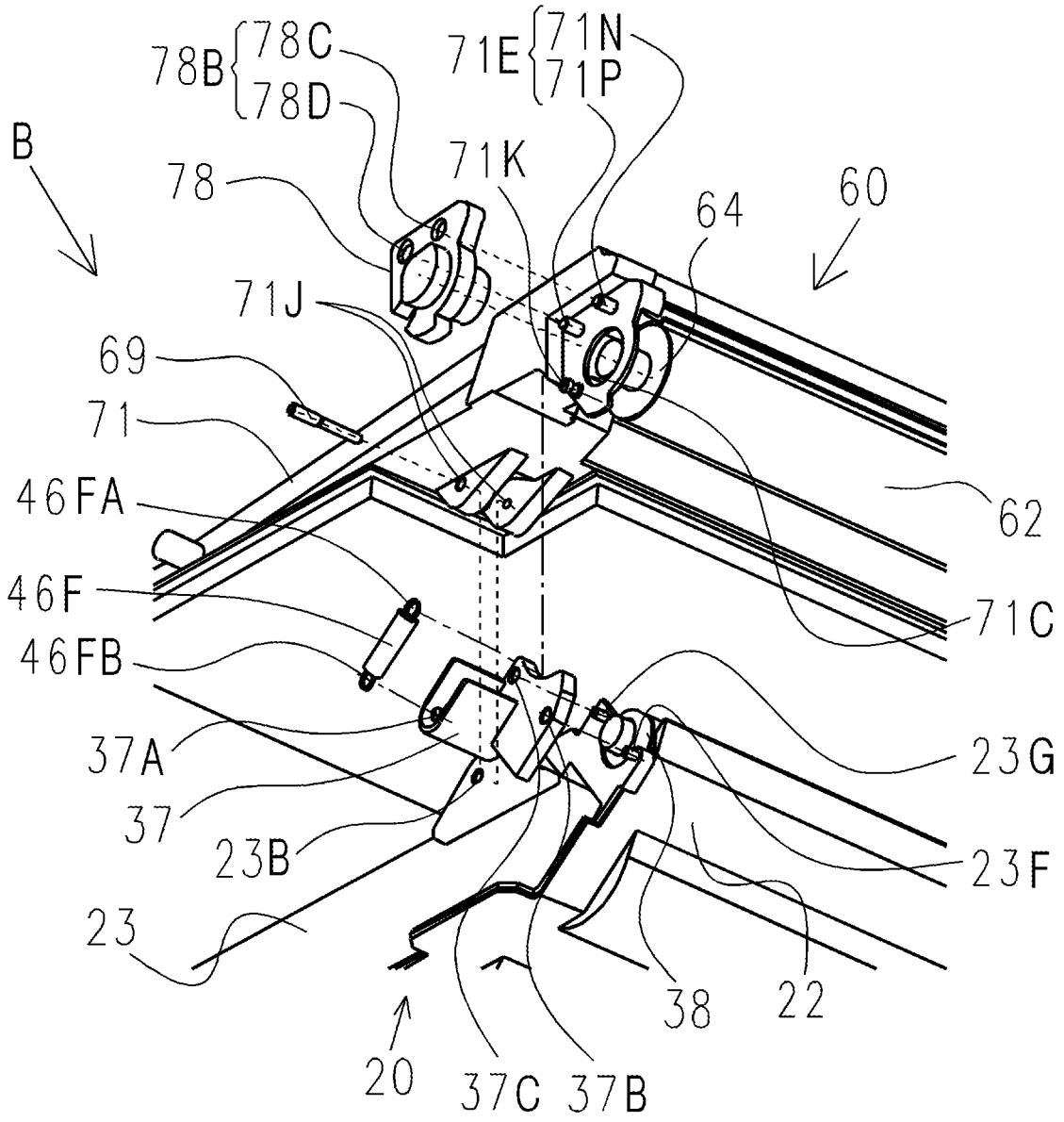
FIG. 11 is an exploded perspective view of the process cartridge in First Embodiment.
Figure 12:
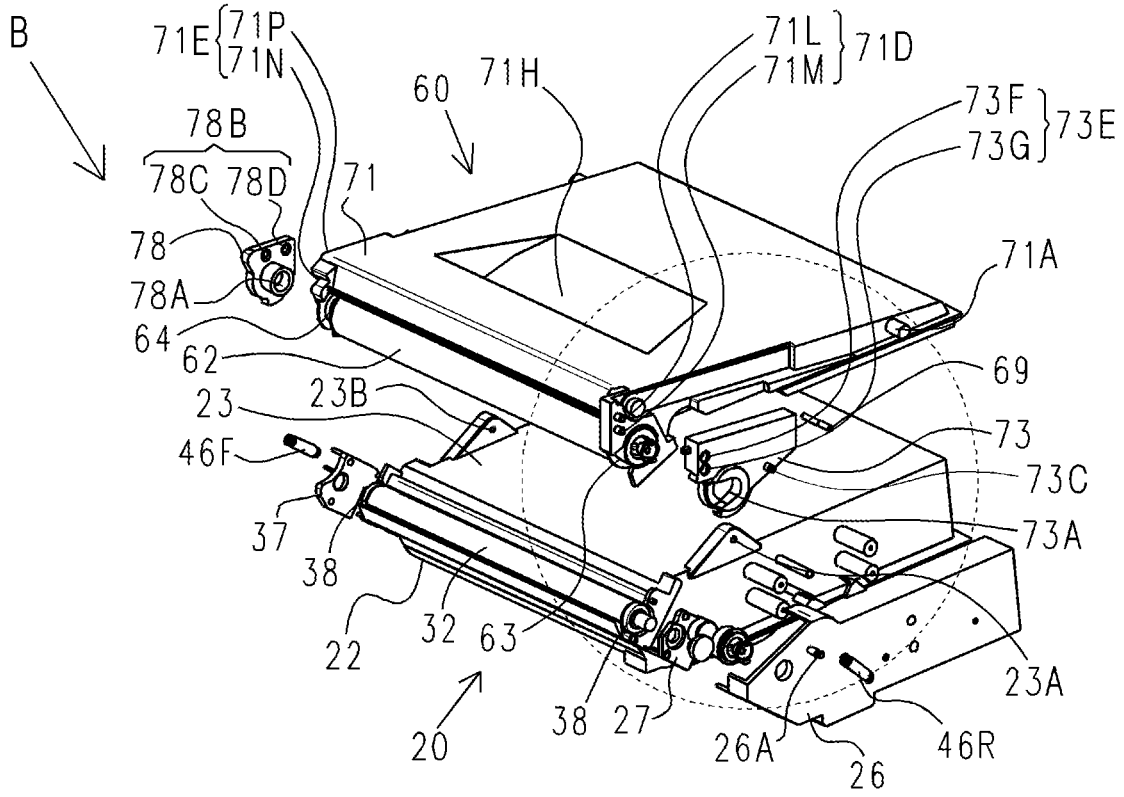
FIG. 12 is an exploded perspective view of the process cartridge in First Embodiment.
Figure 13:
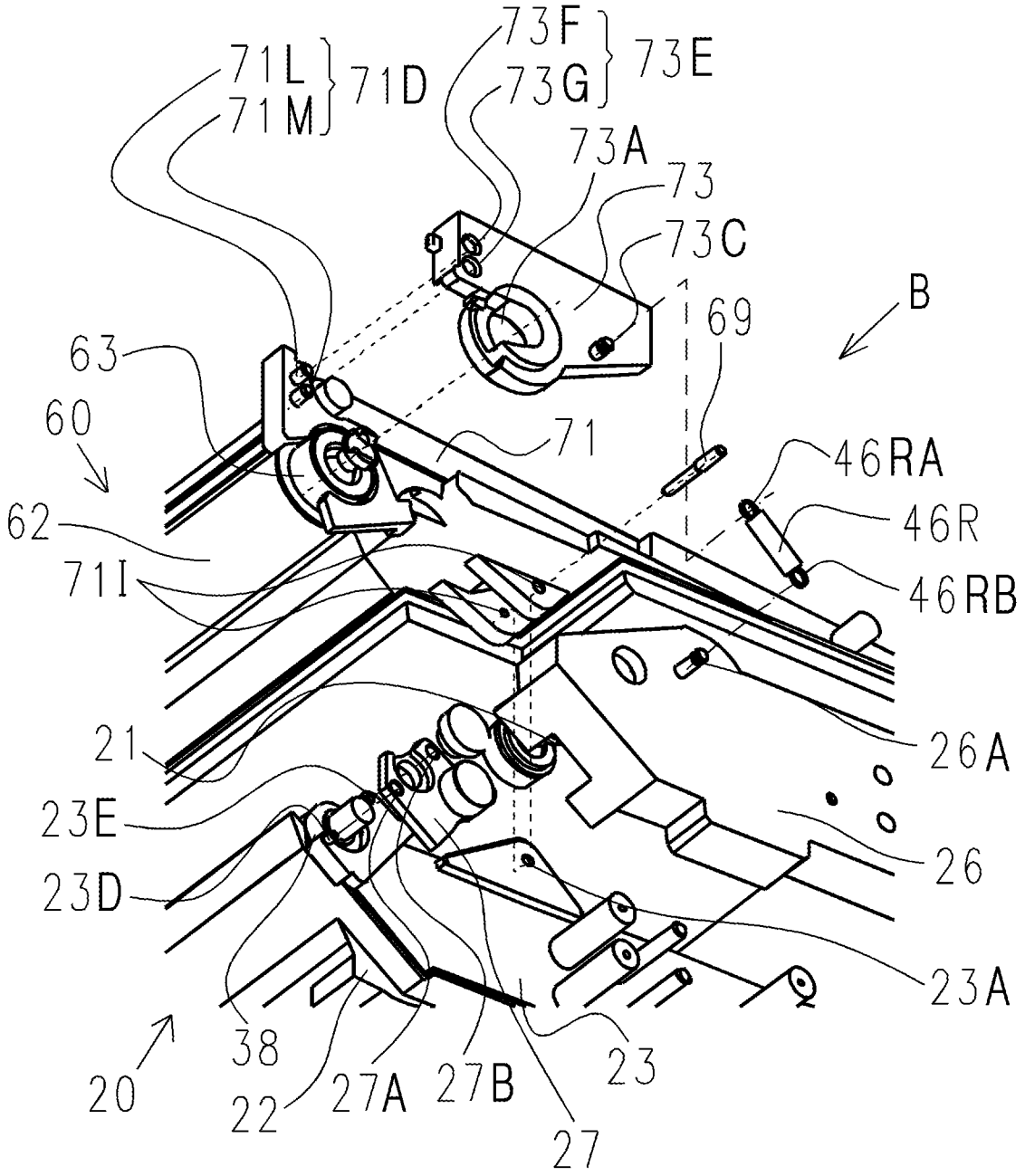
FIG. 13 is an exploded perspective view of the process cartridge in First Embodiment.

As illustrated in FIGS. 10 and 12, the cartridge B includes the cleaning unit 60 and the development unit 20 rotatably connected with each other by a connecting pin 69. Specifically, at the developer container 23 at the longitudinal opposite ends of the development unit 20, a first support hole 23A and a second support hole 23B are provided. Further, as illustrated in FIGS. 11 and 13, at the cleaning frame 71 at the longitudinal opposite ends of the cleaning unit 60, a first suspending hole 711 and a second suspending hole 71J are provided. The connecting pin 69 pressed and fixed in the first suspending hole 711 and the first support hole 23A are fitted with each other, and the connecting pin 69 pressed and fixed in the second suspending hole 71J and the second support hole 23B are fitted with each other. As a result, the cleaning unit 60 and the development unit 20 are rotatably connected with each other.

As illustrated in FIG. 13, a first hole 46RA of a driving side urging member 46R is engaged with the boss 73C of the driving side drum bearing 73, and a second hole 46RB is engaged with the boss 26A of a development side member 26. Further, as illustrated in FIG. 11, the first hole 46FA of the non-driving side urging member 46F is engaged with the boss 71K of the cleaning frame 71, and the second hole 46FB is engaged with the boss 37A of the non-driving side development roller bearing 37. In Embodiment 1, the driving side urging member 46R and the non-driving side urging member 46F are each formed of an extension spring. The urging force of this spring urges the development unit 20 to the cleaning unit 60, so that the development roller 32 can be pressed against the drum 62 with reliability. Then, as illustrated in FIG. 10, gap maintaining members 38 attached at the opposite ends of the development roller 32 hold the development roller 32 with a predetermined clearance from the drum 62.

Configuration of Cleaning Unit

Then, a configuration of the cleaning unit 60 will be described by reference to FIGS. 3, 4A, 4B, 10, 11, 12, and 13. The cleaning unit 60 has the drum 62, the charging roller 66, and the cleaning blade 77, the cleaning frame 71 for supporting them, and a lid member 72 fixed to the cleaning frame 71 by welding or the like. The cleaning blade 77 is fixed to the cleaning frame 71. At the cleaning unit 60, the charging roller 66 and the cleaning blade 77 are respectively placed in contact with the drum outer peripheral surface 62A (see FIG. 3).

As illustrated in FIG. 3, the cleaning blade 77 has a rubber blade 77A of a blade-shaped elastic member formed of rubber as an elastic material, and a support member 77B for supporting the rubber blade 77A. The rubber blade 77A is in contact with the drum outer peripheral surface 62A in the counter direction with respect to the rotation direction of the drum 62. Namely, the rubber blade 77A is in contact with the drum outer peripheral surface 62A so that the rubber blade leading end portion 77C of the rubber blade 77A points to the upstream side of the drum rotation direction R1. Therefore, the drum outer peripheral surface 62A faces the rubber blade leading end portion 77C of the rubber blade 77A. Herein, the direction of the rubber blade 77A with respect to the drum 62 is referred to as a cleaning blade horizontal direction Xc. Whereas, the direction vertical to the cleaning blade horizontal direction Xc is referred to as a cleaning blade vertical direction Yc. Incidentally, in the present Embodiment, the support member 77B is a metal sheet having a bending part. Further, the cleaning blade horizontal direction Xc is the direction for connecting the bending part of the support member 77B and the leading end portion of the support member 77B to which the rubber blade 77A is attached. Whereas, the cleaning blade vertical direction Yc is the thickness direction of support member 77B at the part between the bending part of the support member 77B and the leading end portion of the support member 77B to which the rubber blade 77A is attached. Incidentally, the cleaning blade vertical direction Yc and the cleaning blade horizontal direction Xc herein mentioned are set in the natural state with the cleaning blade 77 (the state before coming in contact with the drum 62).

The cleaning blade 77 removes the waste toner from the drum outer peripheral surface 62A. As illustrated in FIGS. 3 and 4A and 4B, the removed waste toner is conveyed by a first screw 86, a second screw 87, and a third screw 88 as waste toner conveying members, and is stored in a waste toner chamber 71B formed by the cleaning frame 71 and the lid member 72. Namely, the first screw 86, the second screw 87, and the third screw 88 convey the waste toner toward the waste toner chamber 71B. The waste toner chamber 71B is one example of the accommodation portion. Further, the first screw 86 is rotated in response to transmission of a drive from a second coupling 21 illustrated in FIG. 13 by a first screw gear (not illustrated). Then, the second screw 87 and the third screw 88 are rotated in response to a driving force from the first screw 86 and from the second screw 87, respectively. The first screw 86 is disposed in the vicinity of the drum 62, the second screw 87 is disposed at the longitudinal end of the cleaning frame 71 and the third screw 88 is disposed in the waste toner chamber 71B. Herein, the rotation axes of the first screw 86 and the third screw 88 are in parallel with the rotation axis of the drum 62, and the rotation axis of the second screw 87 is orthogonal to the rotation axis of the drum 62.

As illustrated in FIG. 3, a scooping sheet 65 for preventing the waste toner from leaking from the cleaning frame 71 is provided at the edge of the cleaning frame 71 so as to be in contact with the drum 62. The drum 62 receives a driving force from a main body driving motor (not illustrated) of a driving source, thereby to be rotationally driven in the drum rotation direction R1 according to the image forming operation. The charging roller 66 is rotatably attached to the cleaning unit 60 at the opposite ends in the longitudinal direction of the cleaning frame 71 (substantially in parallel with the rotational axial direction of the drum 62) via the charging roller bearing 67. The charging roller 66 is pressure welded to the drum 62 by pressurizing the charging roller bearing 67 against the drum 62 by the urging member 68. The charging roller 66 is rotated following the rotation of the drum 62.

As illustrated in FIG. 3, the cleaning unit 60 is provided with the cleaning frame 71, the lid member 72, and the drum 62. As illustrated in FIGS. 10 and 12, the cleaning unit 60 is provided with the driving side drum bearing 73 and the non-driving side drum bearing 78 as bearing members for rotatably supporting the drum 62. Further, the drum 62 is rotatably attached to the cleaning frame 71 by the driving side drum bearing 73 and the non-driving side drum bearing 78 provided at the opposite ends in the rotational axial direction of the drum 62. As the materials for the driving side drum bearing 73, the non-driving side drum bearing 78, and the cleaning frame 71, thermoplastic resins such as polystyrene, ABS, and polyacetal can be used.

As illustrated in FIG. 13, on the driving side, the driving side drum flange 63 as the support shaft provided at the drum 62 is rotatably supported by the drum flange pivotally supporting hole 73A. The cleaning frame 71 is provided with a drum bearing fixing shaft 71D as an adjustment shaft on the driving side. The drum bearing fixing shaft 71D includes a first drum bearing fixing shaft 71L and a second drum bearing fixing shaft 71M. The driving side drum bearing 73 is provided with a drum bearing adjustment hole 73E as an adjustment hole on the driving side. The drum bearing adjustment hole 73E includes a first drum bearing adjustment hole 73F and a second drum bearing adjustment hole 73G. In other words, in the present Embodiment, on the driving side, the cleaning frame 71 is provided with a plurality of adjustment shafts. On the other hand, the driving side drum bearing 73 is provided with a plurality of adjustment holes. Incidentally, the number of the adjustment shafts and the number of the adjustment holes on the driving side may be singular or plural.

The diameter of the first drum bearing adjustment hole 73F is set larger than the diameter of the first drum bearing fixing shaft 71L. Whereas, the diameter of the second drum bearing adjustment hole 73G is set larger than the diameter of the second drum bearing fixing shaft 71M. In Embodiment 1, for example, each diameter of the first drum bearing adjustment hole 73F and the second drum bearing adjustment hole 73G is 5 mm, and each diameter of the first drum bearing fixing shaft 71L and the second drum bearing fixing shaft 71M is 4 mm. For this reason, the difference between the diameter of the hole and the diameter of the shaft is 1 mm. However, the outer diameters of the hole and axis necessary in terms of function may be appropriately selected. The difference between the diameter of the hole and the diameter of the shaft may also be appropriately selected similarly. However, in view of the processing errors of the cleaning frame 71, the drum 62, and the driving side drum bearing 73, the difference between the diameter of the hole and the diameter of the shaft is preferably set within the range of 0.2 mm or more and 1.6 mm or less. As illustrated in FIG. 13, the first drum bearing adjustment hole 73F is engaged with the first drum bearing fixing shaft 71L and the second drum bearing adjustment hole 73G is engaged with the second drum bearing fixing shaft 71M. The fixing means for the driving side drum bearing 73 to the cleaning frame 71 will be described later.

On the other hand, as illustrated in FIGS. 11 and 12, on the non-driving side, a non-driving side drum flange 64 as a support shaft part provided at the drum 62 is rotatably supported by the drum flange pivotally supporting hole 78A. The cleaning frame 71 is provided with the drum bearing fixing shaft 71E as the adjustment shaft on the non-driving side. The drum bearing fixing shaft 71E includes a first drum bearing fixing shaft 71N and a second drum bearing fixing shaft 71P. The non-driving side drum bearing 78 is provided with a drum bearing adjustment hole 78B as the adjustment hole on the non-driving side. The drum bearing adjustment hole 78B includes a first drum bearing adjustment hole 78C and a second drum bearing adjustment hole 78D. In other words, in the present Embodiment, on the non-driving side, the cleaning frame 71 is provided with a plurality of adjustment shafts. On the other hand, the non-driving side drum bearing 78 is provided with a plurality of adjustment holes. Incidentally, the number of the adjustment shafts and the number of the adjustment holes on the non-driving side may be singular or plural. Whereas, the number of the adjustment shafts and the number of the adjustment holes on the non-driving side may be different from the number of adjustment shafts and the number of the adjustment holes on the driving side.

The diameter of the first drum bearing adjustment hole 78C is set larger than the diameter of the first drum bearing fixing shaft 71N. Whereas, the diameter of the second drum bearing adjustment hole 78D is set larger than the diameter of the second drum bearing fixing shaft 71P. In Embodiment 1, for example, each diameter of the first drum bearing adjustment hole 78C and the second drum bearing adjustment hole 78D is 5 mm, and each diameter of the first drum bearing fixing shaft 71N and the second drum bearing fixing shaft 71P is 4 mm. For this reason, the difference between the diameter of the hole and the diameter of the shaft is 1 mm. However, as with the driving side, the outer diameters of the hole and the shaft necessary in terms of function may be appropriately selected as on the driving side. The difference between the diameter of the hole and the diameter of the shaft is also preferably set within the range of 0.2 mm or more and 1.6 mm or less as with the driving side. As illustrated in FIG. 11, the first drum bearing adjustment hole 78C is engaged with the first drum bearing fixing shaft 71N and the second drum bearing adjustment hole 78D is engaged with the second drum bearing fixing shaft 71P. The fixing means for the non-driving side drum bearing 78 to the cleaning frame 71 will be described later.

Configuration of Development Unit

Then, a configuration of the development unit 20 will be described by reference to FIGS. 3, 4A, 4B, 10, 11, 12, and 13. As illustrated in FIG. 3, the development unit 20 has the development roller 32, the developer container 23, the development blade 42, and the like. In the development roller 32, the magnet roller 34 is provided. Whereas, in the development unit 20, the development blade 42 for regulating the toner layer on the development roller 32 is placed. The development blade 42 regulates the thickness of the toner supported by the development roller 32. The development blade 42 is also in contact in the counter direction with respect to the rotation direction of the development roller 32 as with the cleaning blade 77. Namely, the development blade 42 is in contact so as to face the upstream side of the rotation direction of the development roller 32. Herein, the direction of the development blade 42 with respect to the development roller 32 is referred to as a development blade vertical direction Yd. Whereas, the direction vertical to the development blade vertical direction Yd is referred to as a development blade horizontal direction Xd. Incidentally, in the present Embodiment, the development blade 42 is a metal sheet, and is attached to a support sheet having a bending part. The development blade vertical direction Yd is the direction for connecting the portion of the development blade 42 attached at the support sheet, and the leading end portion of the development blade 42. Whereas, the development blade horizontal direction Xd is the thickness direction of the development blade 42 between the portion of the development blade 42 attached at the support sheet and the leading end portion of the development blade 42. Incidentally, the development blade vertical direction Yd and the development blade horizontal direction Xd herein mentioned are set in the natural state of the development blade 42 (the state before contact with the development roller 32).

As illustrated in FIGS. 10 and 12, to the development roller 32, the clearance holding members 38 are attached at the opposite ends of the development roller 32. The clearance holding members 38 and the drum 62 come in contact with each other, so that the development roller 32 is held with a minute clearance from the drum 62. Further, as illustrated in FIG. 3, a bleeding out prevention sheet 33 for preventing the toner from leaking from the development unit 20 is provided at the edge of a bottom member 22 so as to be in contact with the development roller 32. Further, the toner chamber 29 formed of the developer container 23 and the bottom member 22 is provided with the first conveying member 43, the second conveying member 44, and the third conveying member 50. The first conveying member 43, the second conveying member 44, and the third conveying member 50 stir the toner accommodated in the toner chamber 29, and convey the toner to the toner supply chamber 28. On the other hand, as illustrated in FIGS. 3, 10, and 12, the development unit 20 includes the bottom member 22, the developer container 23, the development side member 26, the development blade 42, the development roller 32, and the like. Whereas, the development roller 32 is rotatably attached to the developer container 23 by a driving side development roller bearing 27 and a non-driving side development roller bearing 37 provided at the opposite ends in the rotational axial direction of the development roller 32.

As illustrated in FIGS. 10 and 12, the development unit 20 is provided with the developer container 23 and the bottom member 22. Further, as illustrated in FIGS. 10 and 12, the development unit 20 is provided with the development roller 32, the driving side development roller bearing 27 and the non-driving side development roller bearing 37 as bearing members for pivotally supporting the development roller 32 rotatably. As the materials for the driving side development roller bearing 27, the non-driving side development roller bearing 37, and the developer container 23, thermoplastic resins such as polystyrene, ABS, and polyacetal can be used.

As illustrated in FIG. 12, the development roller 32 is pivotally supported rotatably by the driving side development roller bearing 27 on the driving side. As illustrated in FIG. 13, the developer container 23 is provided with a first development bearing fixing shaft 23D and a second development bearing fixing shaft 23E as adjustment shafts on the driving side. The driving side development roller bearing 27 is provided with a first development bearing adjustment hole 27A and a second development bearing adjustment hole 27B as adjustment holes on the driving side. The diameter of the first development bearing adjustment hole 27A is set larger than the diameter of the first development bearing fixing shaft 23D. Whereas, the diameter of the second development bearing adjustment hole 27B is set larger than the diameter of the second development bearing fixing shaft 23E. In Embodiment 1, each diameter of the first development bearing adjustment hole 27A and the second development bearing adjustment hole 27B is 4 mm, and each diameter of the first development bearing fixing shaft 23D and the second development bearing fixing shaft 23E is 3 mm. Accordingly, the difference between the diameter of the hole and the diameter of the shaft is 1 mm. However, the outer diameter of the hole and the shaft necessary in terms of function may be appropriately selected. The difference between the diameter of the hole and the diameter of the shaft may also be appropriately selected similarly. However, in view of the processing errors of the developer container 23, the development roller 32, and the driving side development roller bearing 27, the difference between the diameter of the hole and the diameter of the shaft is preferably set within the range of 0.2 mm or more and 1.6 mm or less. As illustrated in FIG. 13, the first development bearing adjustment hole 27A is engaged with the first development bearing fixing shaft 23D and the second development bearing adjustment hole 27B is engaged with the second development bearing fixing shaft 23E. The fixing method for the driving side development roller bearing 27 to the developer container 23 will be described later.

On the other hand, as illustrated in FIG. 10, the development roller 32 is pivotally supported rotatably by the non-driving side development roller bearing 37 on the non-driving side. As illustrated in FIG. 11, the developer container 23 is provided with a first development bearing fixing shaft 23F and a second development bearing fixing shaft 23G as adjustment shafts on the non-driving side. The non-driving side development roller bearing 37 is provided with a first development bearing adjustment hole 37B and a second development bearing adjustment hole 37C as adjustment holes on the non-driving side. The diameter of the first development bearing adjustment hole 37B is set larger than the diameter of the first development bearing fixing shaft 23F. Whereas, the diameter of the second development bearing adjustment hole 37C is set larger than the diameter of the second development bearing fixing shaft 23G In Embodiment 1, for example, each diameter of the first development bearing adjustment hole 37B and the second development bearing adjustment hole 37C is 4 mm, and each diameter of the first development bearing fixing shaft 23F and the second development bearing fixing shaft 23G is 3 mm. Accordingly, the difference between the diameter of the hole and the diameter of the shaft is 1 mm. However, the outer diameters of the hole and the shaft necessary in terms of function may be appropriately selected. The difference between the diameter of the hole and the diameter of the shaft is also preferably set within the range of 0.2 mm or more and 1.6 mm or less as with the driving side. As illustrated in FIG. 11, the first development bearing adjustment hole 37B is engaged with the first development bearing fixing shaft 23F and the second development bearing adjustment hole 37C is engaged with the second development bearing fixing shaft 23G The fixing means for the non-driving side development roller bearing 37 to the developer container 23 will be described later.

Assembly Method of Drum Bearing

Figure 1A:
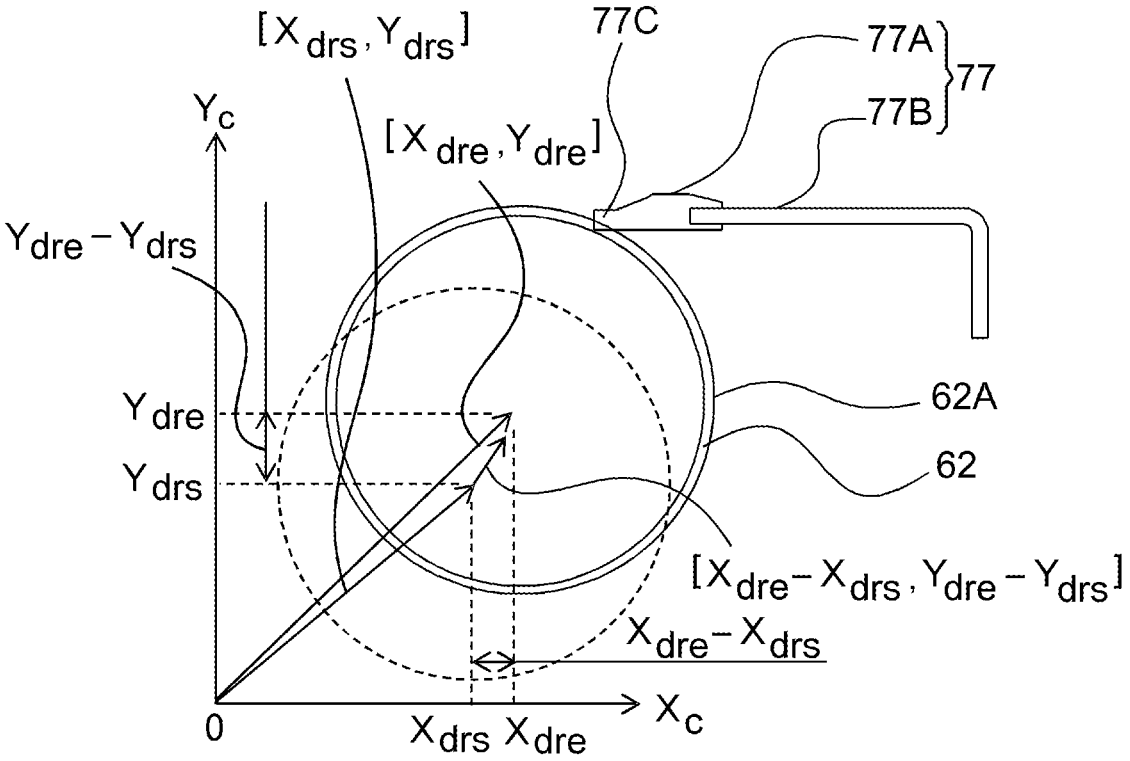
FIGS. 1A and 1B are each a cross sectional view for illustrating a step of adjustment and assembly in First Embodiment.
Figure 1B:
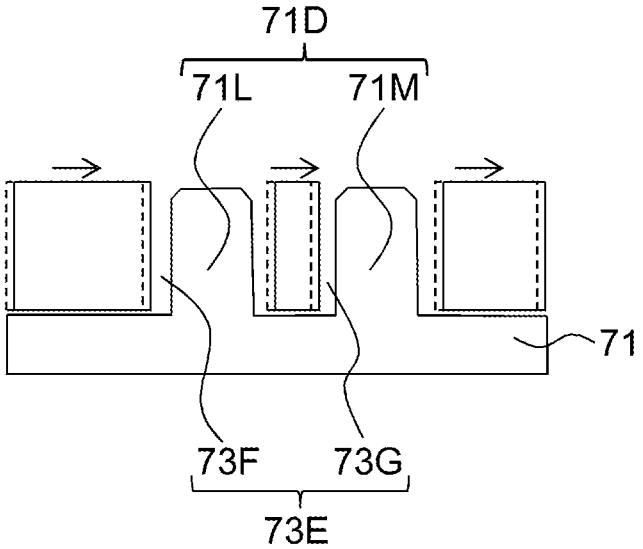
Figure 14:
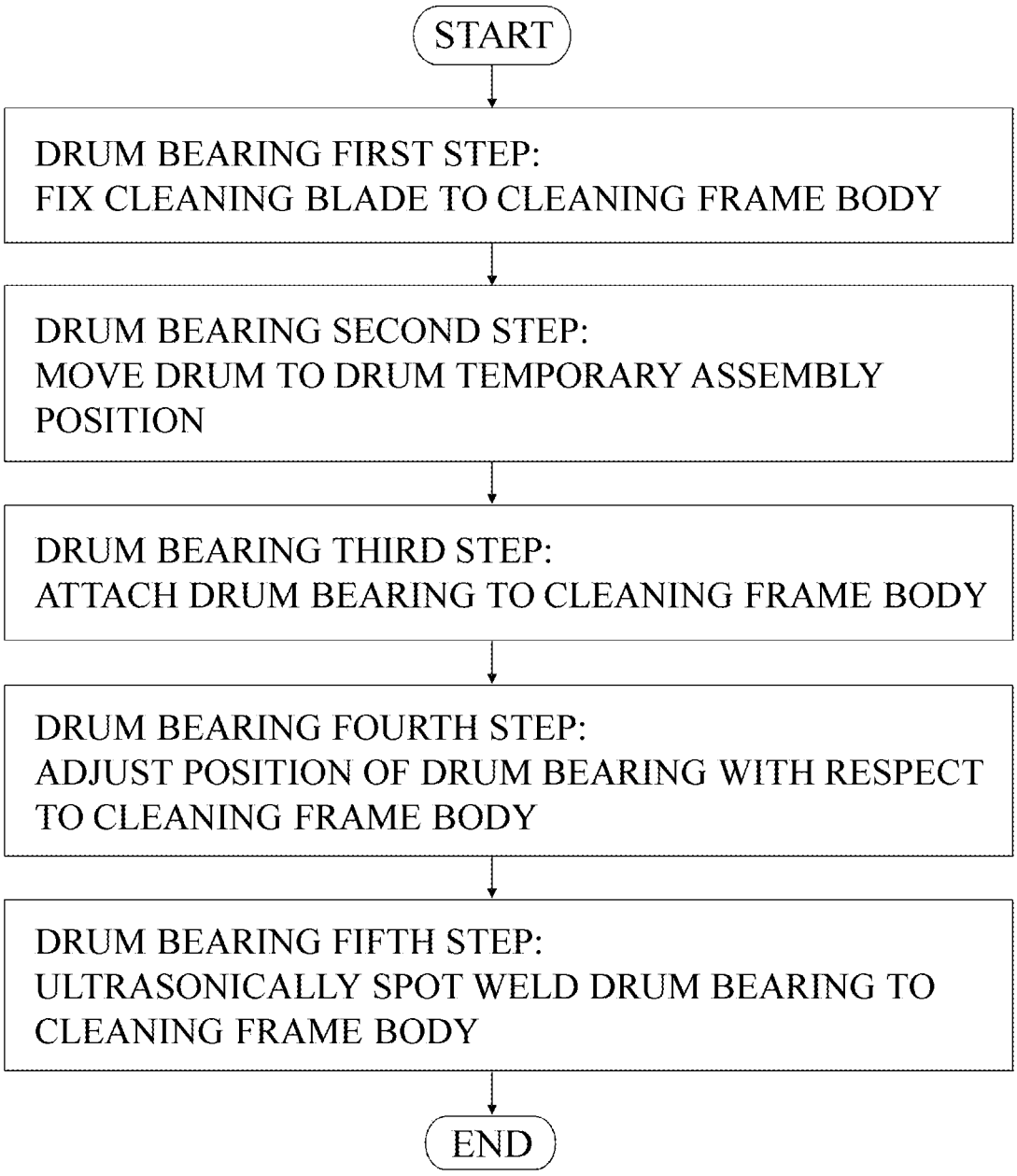
FIG. 14 is a flowchart for illustrating the assembly step of a drum bearing in First Embodiment.
Figure 15A:
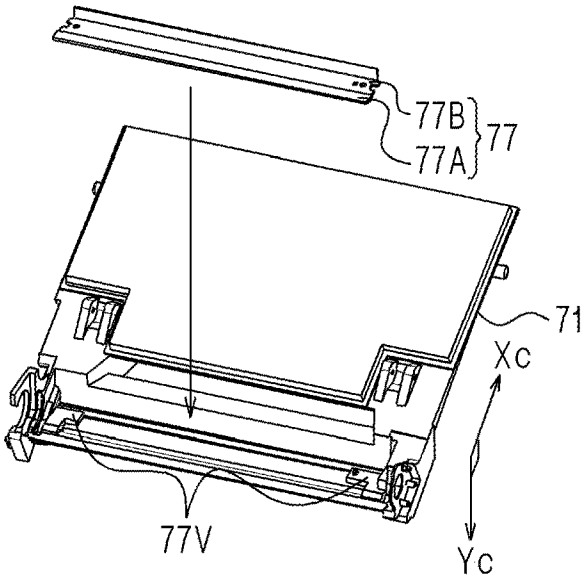
FIGS. 15A and 15B are each an exploded perspective view.
Figure 15B:
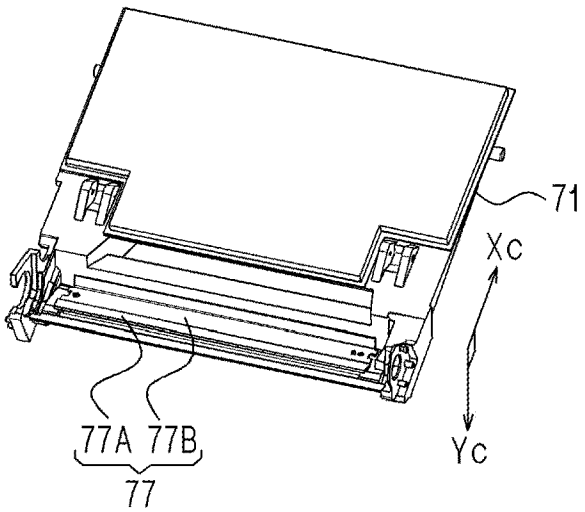
Figure 15C:
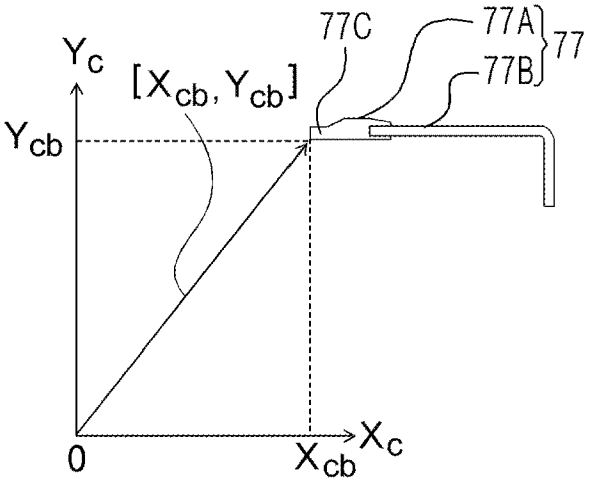
FIG. 15C is a transverse cross sectional view for illustrating a drum bearing first step in First Embodiment.
Figure 16A:
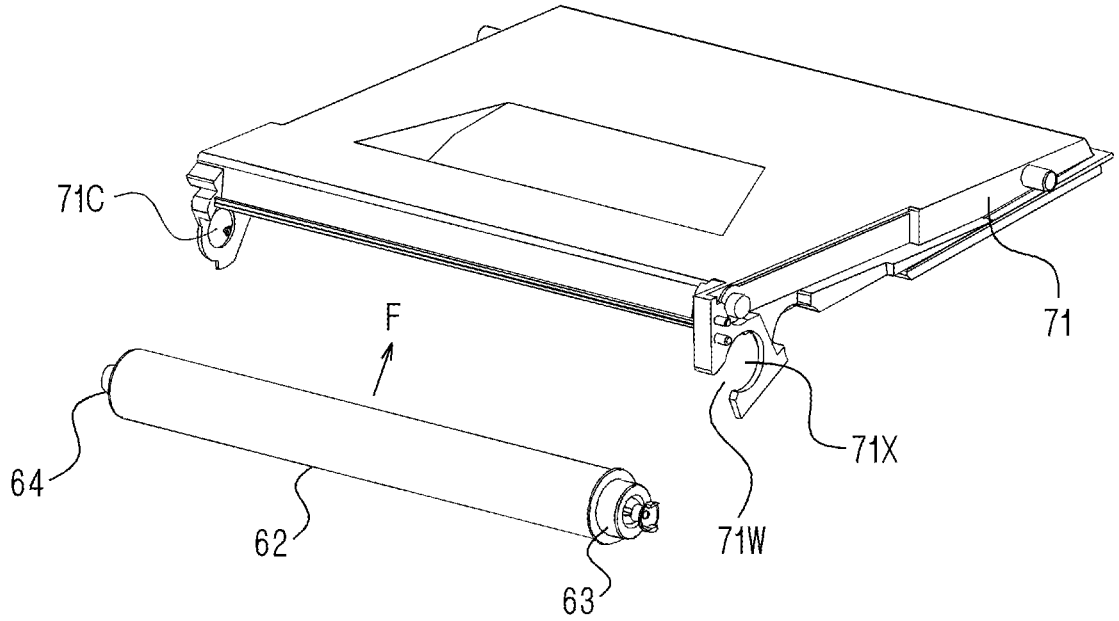
FIGS. 16A and 16B are each an exploded perspective view for illustrating a drum bearing second step in First Embodiment.
Figure 16B:
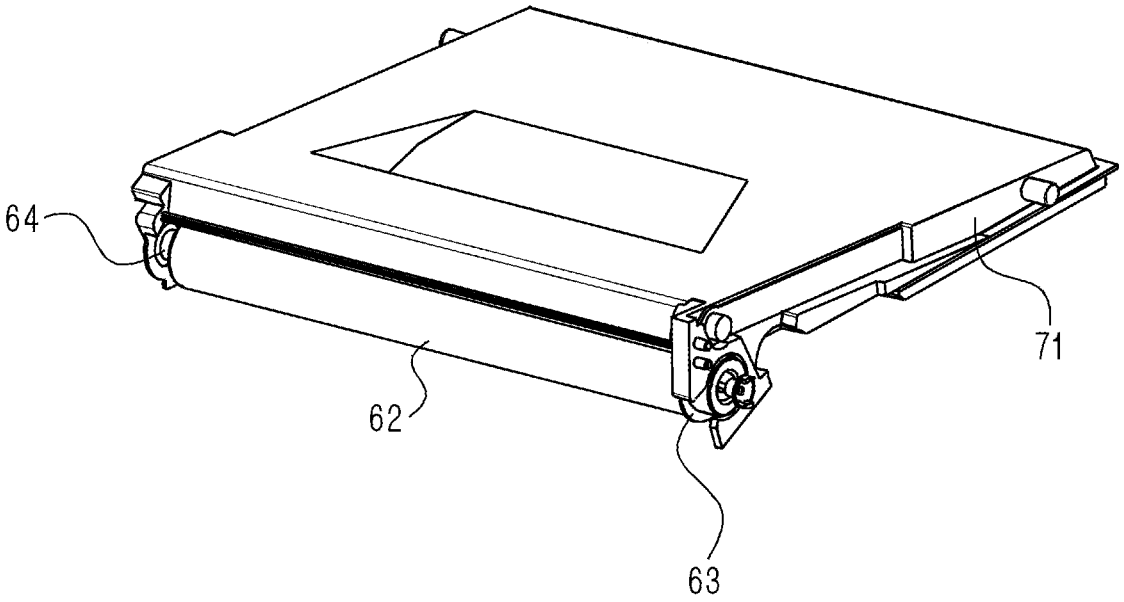
Figure 17A:
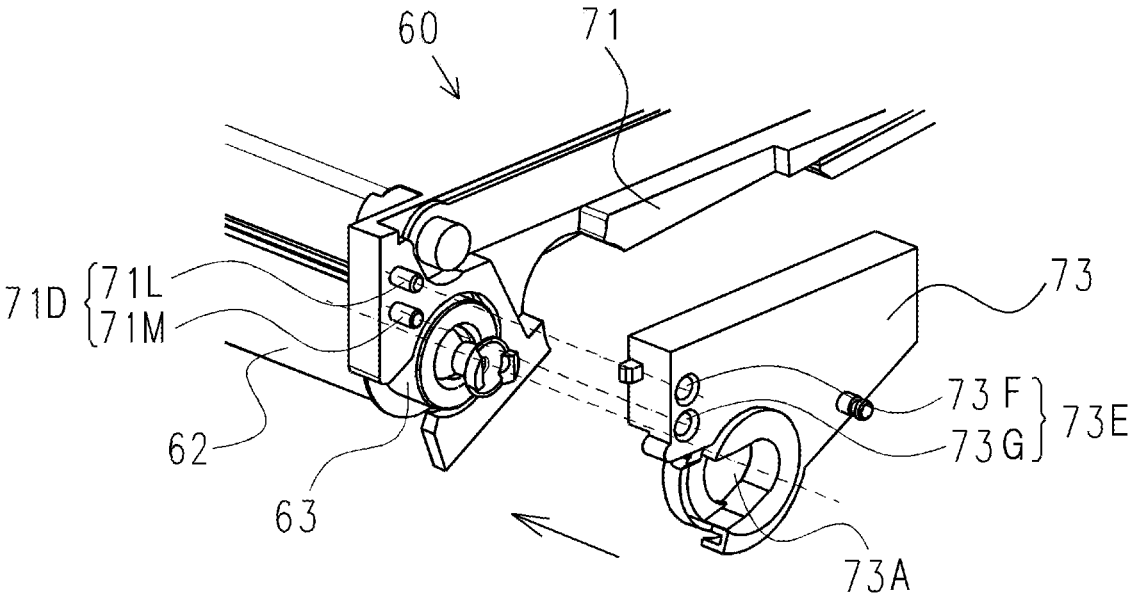
FIGS. 17A and 17B are each an exploded perspective view for illustrating a drum bearing third step in First Embodiment.
Figure 17B:
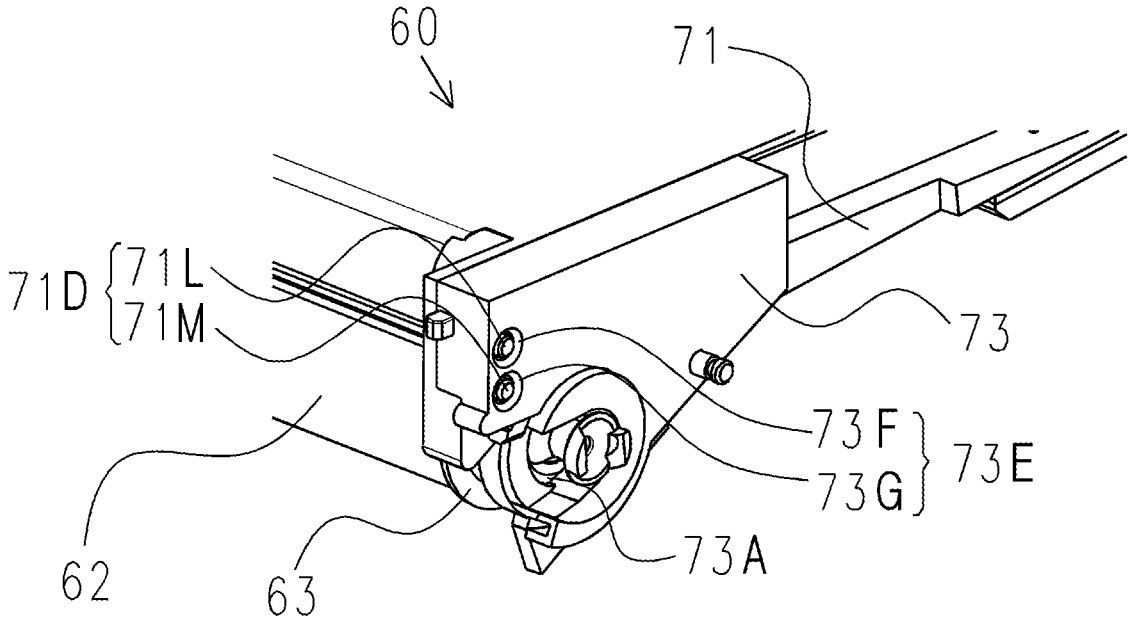
Figure 18A:
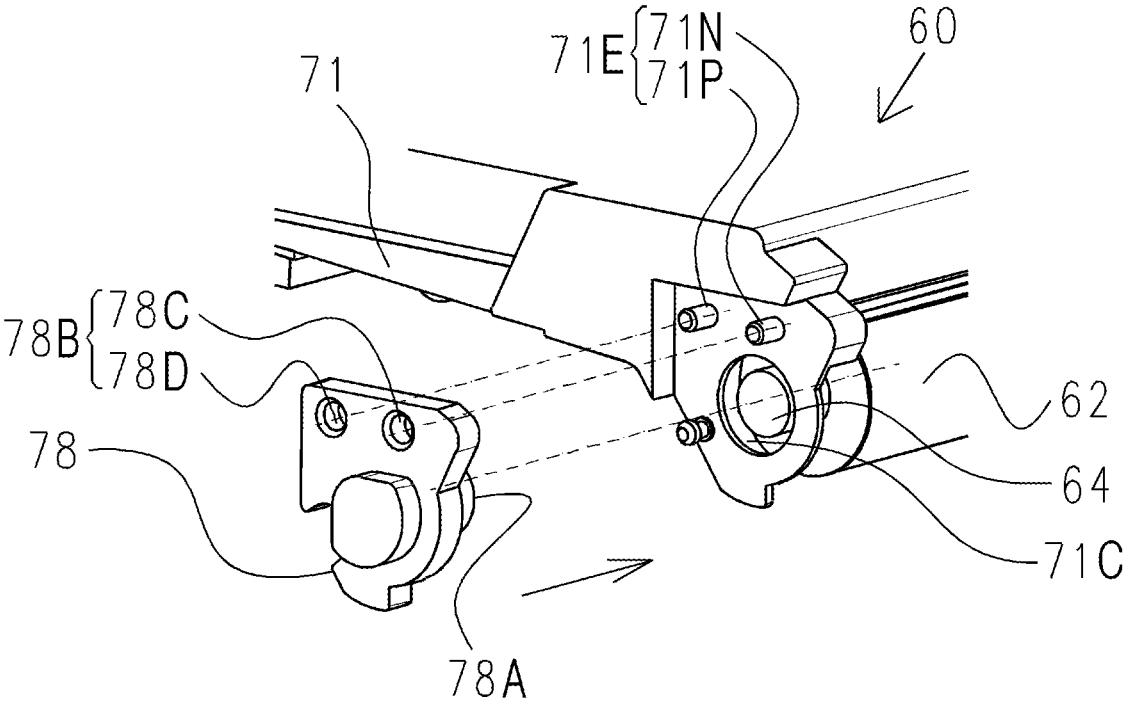
FIGS. 18A and 18B are each an exploded perspective view for illustrating the drum bearing third step in First Embodiment.
Figure 18B:
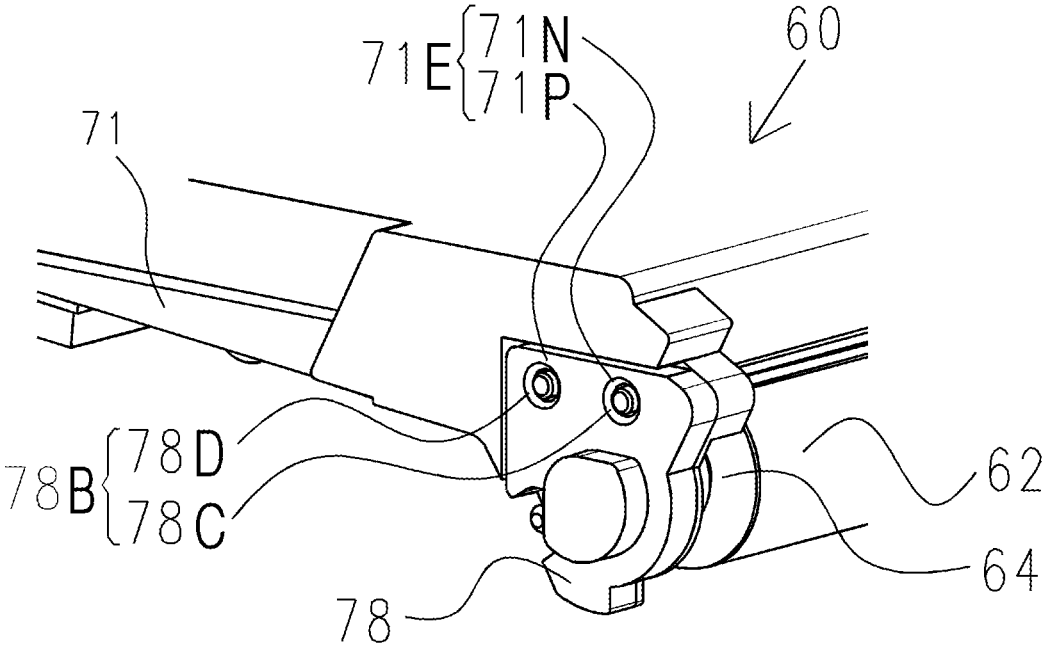
Figure 19A:
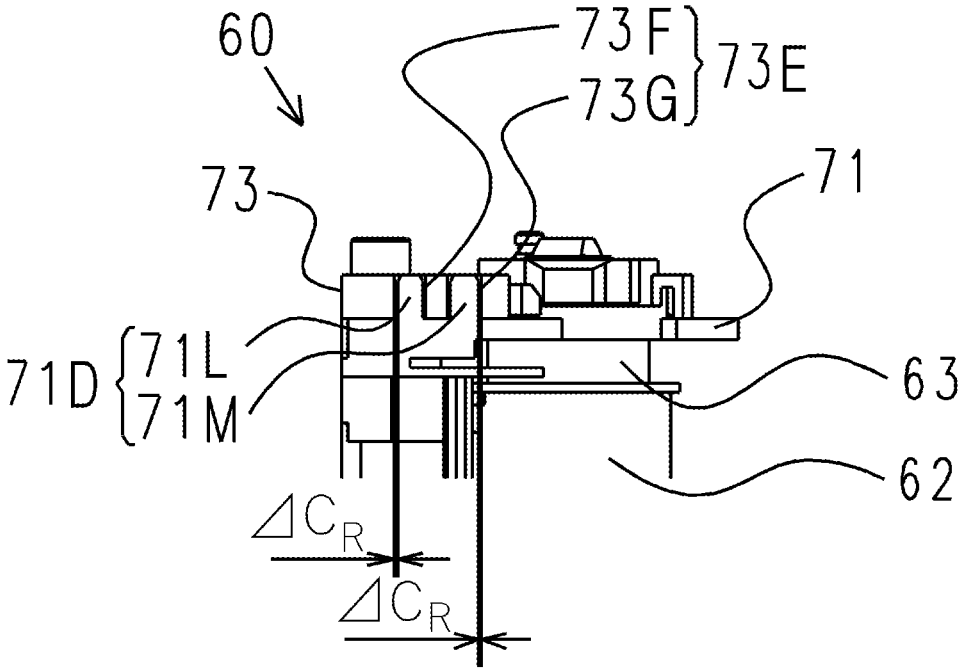
FIGS. 19A and 19B are each a cross sectional view for illustrating the drum bearing third step in First Embodiment.
Figure 19B:
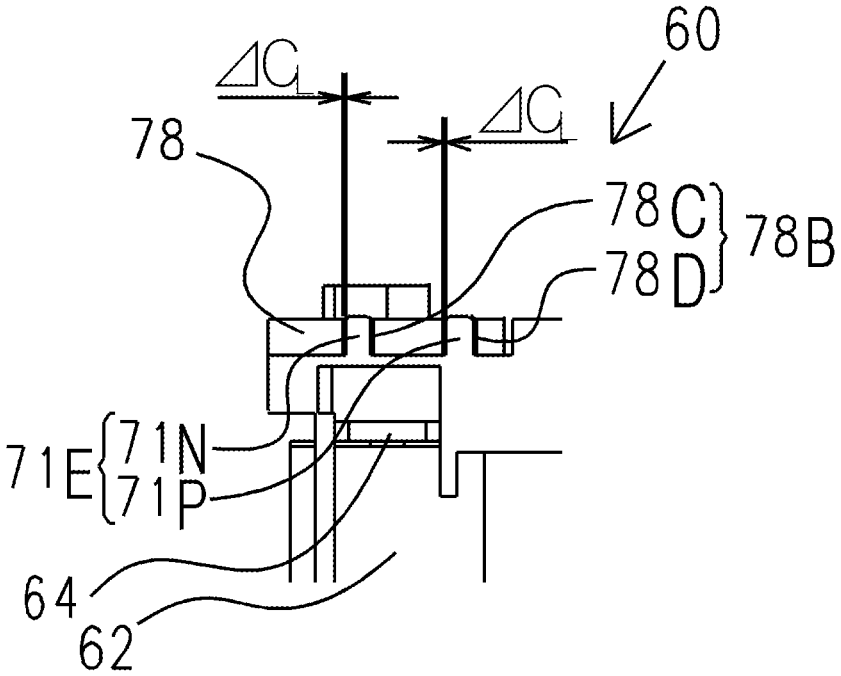
Figure 20A:
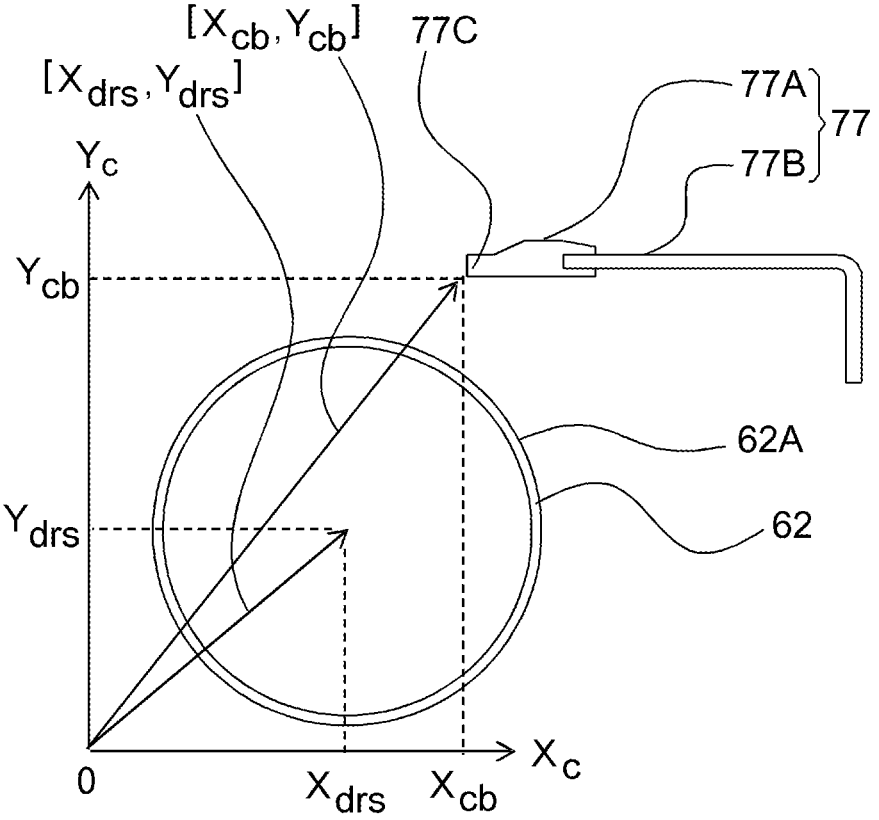
FIGS. 20A and 20B are each a cross sectional view for illustrating a drum bearing fourth step in First Embodiment.
Figure 20B:
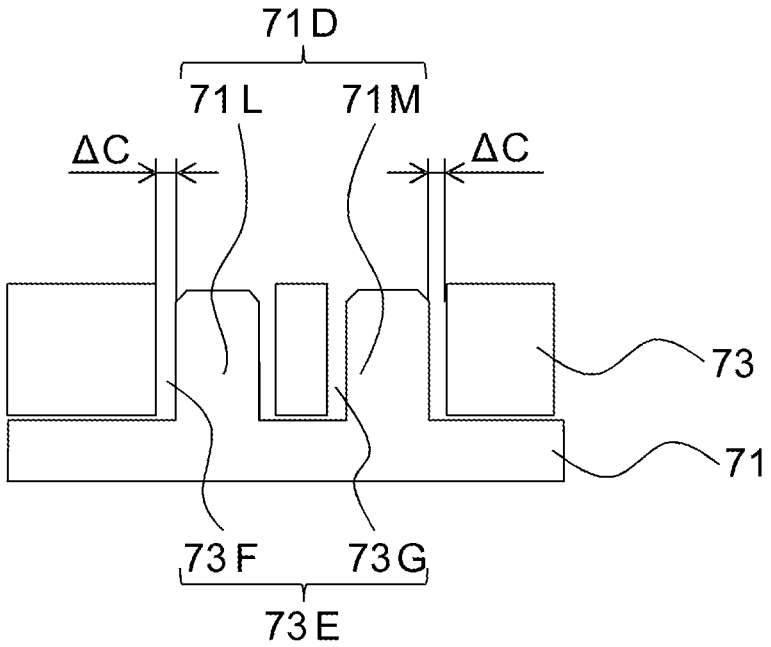
Figure 21A:
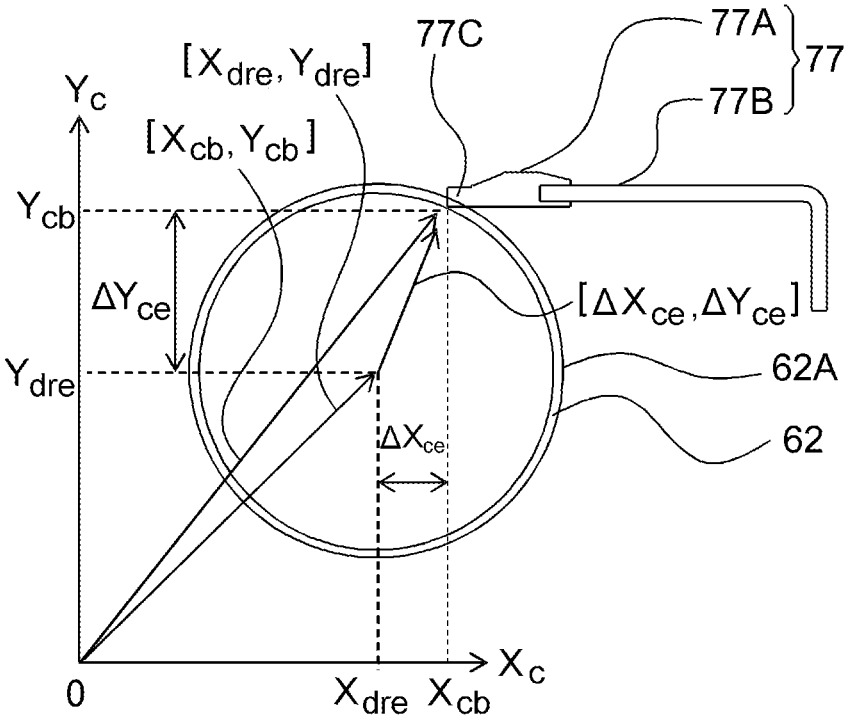
FIGS. 21A to 21C are each a cross sectional view for illustrating the drum bearing fourth step in First Embodiment.
Figure 21B:
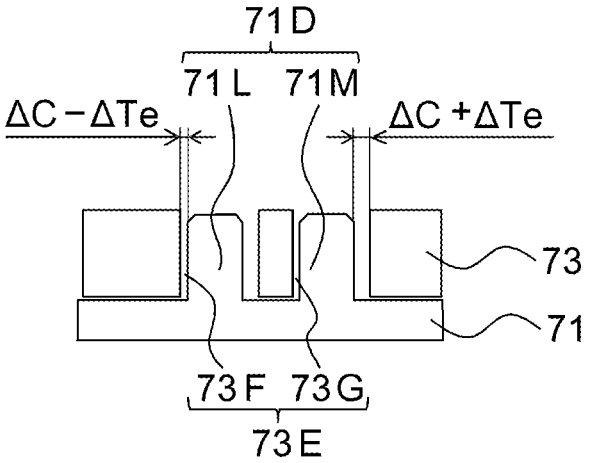
Figure 21C:
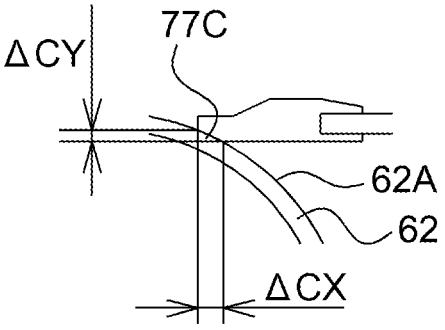

Then, a method for assembling the driving side drum bearing 73 and the non-driving side drum bearing 78 to the cleaning frame 71 will be described by reference to FIGS. 1A and 1B and FIGS. 14 to 22D. FIGS. 1A and 1B are each a transverse cross sectional view for illustrating a relative-position adjusting step of the drum 62 to the cleaning blade 77. FIG. 14 is a flowchart for illustrating the assembly step of the driving side drum bearing 73 and the non-driving side drum bearing 78. FIGS. 15A and 15B are each an exploded perspective view for illustrating a drum bearing first step of FIG. 14, and FIG. 15C is a transverse cross sectional view therefor. FIGS. 16A and 16B are exploded perspective views for illustrating a drum bearing second step of FIG. 14. FIGS. 17A and 17B, and 18A and 18B are each an exploded perspective view for illustrating a drum bearing third step of FIG. 14. FIGS. 19A and 19B are each a longitudinal cross sectional view of the driving side drum bearing 73 and the non-driving side drum bearing 78 after the drum bearing third step of FIG. 14. FIGS. 20A and 20B are each a transverse cross sectional view for illustrating the state before adjusting the relative position of the drum 62 with respect to the cleaning blade 77 in the drum bearing fourth step of FIG. 14. FIGS. 1A and 1B are each a transverse cross sectional view for illustrating the state in which the relative position of the drum 62 with respect to the cleaning blade 77 is adjusted in the drum bearing fourth step of FIG. 14. FIGS. 21A to 21C are each a transverse cross sectional view for illustrating the state after adjusting the relative position of the drum 62 with respect to the cleaning blade 77 in the drum bearing fourth step of FIG. 14. As illustrated in FIG. 14, assembly of the driving side drum bearing 73 and the non-driving side drum bearing 78 to the cleaning frame 71 is performed through the drum bearing first step to the drum bearing fifth step.

The drum bearing first step will be described by reference to FIGS. 14, 15A, 15B, and 15C. FIG. 15A is an exploded perspective view of the cleaning blade 77 and the cleaning frame 71 before assembling the cleaning blade 77 to the cleaning frame 71. FIG. 15B is a perspective view for illustrating the state after assembly of the cleaning blade 77. FIG. 15C is a transverse cross sectional view for illustrating the position on the transverse cross section Xc-Yc of the rubber blade leading end portion 77C after assembly of the cleaning blade 77.

The drum bearing first step is a step of fixing the cleaning blade 77 to the cleaning frame 71 as the previous step of fixing the drum bearing (the driving side drum bearing 73 and the non-driving side drum bearing 78) as illustrated in FIG. 14. Below, the driving side drum bearing 73 and the non-driving side drum bearing 78 will be expressed as a drum bearing as a generic name thereof. In the drum bearing first step, the cleaning blade 77 moves in the cleaning blade vertical direction Yc as illustrated in FIG. 15A, so that the support member 77B comes in contact with a cleaning blade fixing part 71V as illustrated in FIG. 15B. The support member 77B which has come in contact with the cleaning blade fixing part 71V is fastened with the cleaning blade fixing part 71V by a screw (not illustrated). The position on the transverse cross section of the rubber blade leading end portion 77C after screw fastening is expressed by coordinates of the rubber blade leading end portion 77C [$X_{cb}$, $Y_{cb}$] from the predetermined reference position 0 indicated in FIG. 15C. The coordinates of the rubber blade leading end portion 77C [$X_{cb}$, $Y_{cb}$] is measured by a rubber blade tip position measuring apparatus (not illustrated). As the rubber blade tip position measuring apparatus, an optical microscope, a dial gauge, a laser displacement gauge, or the like is used.

The drum bearing second step will be described by reference to FIGS. 14, 16A, and 16B. FIG. 16A is an exploded perspective view of the drum 62 and the cleaning frame 71 before moving the drum 62 to the temporary assembly position to the cleaning unit 60. FIG. 16B is a perspective view for illustrating the state after moving the drum 62 to the temporary assembly position.

The drum bearing second step is a step of moving the drum 62 to the cleaning frame 71 with the cleaning blade 77 fixed thereon as illustrated in FIG. 14. In the drum bearing second step, the drum 62 is moved in a drum temporal assembly direction F as illustrated in FIG. 16A. The driving side drum flange 63 and the non-driving side drum flange 64 are provided at the opposite ends in the rotational axial direction of the drum 62. When the drum 62 is moved in the drum temporal assembly direction F as illustrated in FIG. 16B, the non-driving side drum flange 64 is inserted into a drum flange hole 71C, and the driving side drum flange 63 is inserted into a drum flange hole 71X. The cleaning frame 71 is provided with a drum flange guide part 71W. The drum flange guide part 71W is a notch communicating with the drum flange hole 71X. The drum flange guide part 71W guides the driving side drum flange 63 to the drum flange hole 71X. The driving side drum flange 63 is inserted into the drum flange hole 71X, so that the driving side drum flange 63 is engaged with the drum flange hole 71X. The non-driving side drum flange 64 is inserted into the drum flange hole 71C, so that the non-driving side drum flange 64 is engaged with the drum flange hole 71C. On the driving side of the drum 62, one end in the rotational axial direction of the drum 62 faces the drum flange hole 71X. On the non-driving side of the drum 62, the other end in the rotational axial direction of the drum 62 faces the drum flange hole 71C.

The drum bearing third step will be described by reference to FIGS. 14, 17A, 17B, 18A, 18B, 19A, and 19B. FIG. 17A is an exploded perspective view of the driving side drum bearing 73, the driving side drum flange 63, and the cleaning frame 71 before moving the driving side drum bearing 73 to the temporary assembly position to the cleaning frame 71. FIG. 17B is a perspective view for illustrating the state of the driving side drum bearing 73 after moving to the temporary assembly position. FIG. 18A is an exploded perspective view of the non-driving side drum bearing 78, the non-driving side drum flange 64, and the cleaning frame 71 before moving the non-driving side drum bearing 78 to the temporary assembly position to the cleaning frame 71. FIG. 18B is a perspective view for illustrating the state of the non-driving side drum bearing 78 after moving to the temporary assembly position. FIG. 19A is a longitudinal cross sectional view passing through the drum bearing adjustment hole 73E and the drum bearing fixing shaft 71D. FIG. 19B is a longitudinal cross sectional view passing through the drum bearing adjustment hole 78B and the drum bearing fixing shaft 71E.

The drum bearing third step is a step (attaching step) of attaching the driving side drum bearing 73 and the non-driving side drum bearing 78 to the cleaning frame 71 to which the drum 62 has been moved to the temporary assembly position as illustrated in FIG. 14. In the drum bearing third step, as illustrated in FIGS. 17A and 18A, the driving side drum bearing 73 and the non-driving side drum bearing 78 are moved inwardly in the longitudinal direction of the cleaning frame 71. As a result, the drum 62 is attached to the driving side drum bearing 73 and the non-driving side drum bearing 78.

The driving side drum bearing 73 is moved inwardly in the longitudinal direction of the cleaning frame 71, thereby to attach the drum 62 to the driving side drum bearing 73 as illustrated in FIG. 17B. By fitting the driving side drum flange 63 with the drum flange pivotally supporting hole 73A provided in the driving side drum bearing 73, the drum 62 is attached to the driving side drum bearing 73. Further, the drum bearing fixing shaft 71D provided at the cleaning frame 71 is fitted with the drum bearing adjustment hole 73E provided in the driving side drum bearing 73. The drum bearing fixing shaft 71D is one example of the adjustment shaft. The drum bearing adjustment hole 73E is one example of the adjustment hole. Specifically, the first drum bearing fixing shaft 71L and the first drum bearing adjustment hole 73F are fitted with each other, and the second drum bearing fixing shaft 71M and the second drum bearing adjustment hole 73G are fitted with each other. In this manner, on the longitudinal driving side, the driving side drum bearing 73 is attached to the end of the cleaning frame 71. However, at this time point, the driving side drum bearing 73 and the cleaning frame 71 are not completely fixed. Particularly, the driving side drum bearing 73 and the cleaning frame 71 can be relatively moved in the direction orthogonal to the longitudinal direction.

On the other hand, the non-driving side drum bearing 78 is moved inwardly in the longitudinal direction of the cleaning frame 71, thereby to attach the drum 62 to the non-driving side drum bearing 78 as illustrated in FIG. 18B. The non-driving side drum flange 64 is fitted with the drum flange pivotally supporting hole 78A provided at the non-driving side drum bearing 78, thereby to attach the drum 62 to the non-driving side drum bearing 78. In examples of FIGS. 18A and 18B, the drum flange pivotally supporting hole 78A does not penetrate through the non-driving side drum bearing 78. However, the drum flange pivotally supporting hole 78A may penetrate through the non-driving side drum bearing 78. Further, the drum bearing fixing shaft 71E provided at the cleaning frame 71 is fitted with the drum bearing adjustment hole 78B provided in the non-driving side drum bearing 78. Specifically, the first drum bearing adjustment hole 78C and the first drum bearing fixing shaft 71N are fitted with each other, and the first drum bearing fixing shaft 71N and the second drum bearing adjustment hole 78D are fitted with each other. In this manner, on the longitudinal non-driving side, the non-driving side drum bearing 78 is attached to the end of the cleaning frame 71. However, at this time point, the non-driving side drum bearing 78 and the cleaning frame 71 are not completely fixed. Particularly, the non-driving side drum bearing 78 and the cleaning frame 71 can be relatively moved in the direction orthogonal to the longitudinal direction.

As illustrated in FIG. 19A, on the driving side, an adjusting clearance $\Delta C_R$ equivalent to the difference between the diameter of the drum bearing adjustment hole 73E and the diameter of the drum bearing fixing shaft 71D is provided. Similarly, as illustrated in FIG. 19B, on the non-driving side, an adjusting clearance $\Delta C_L$ equivalent to the difference between the diameter of the drum bearing adjustment hole 78B and the diameter of the drum bearing fixing shaft 71E is provided. The adjusting clearances ($\Delta C_R$ and $\Delta C_L$) are provided in order to prevent the interference between the driving side drum bearing 73 and the non-driving side drum bearing 78, and the cleaning frame 71 in the next drum bearing fourth step.

The drum bearing fourth step will be described by reference to FIGS. 14, 20A, 20B, IA, 1B, 21A, 21B, and 21C. FIG. 20A is a transverse cross sectional view for illustrating the rubber blade leading end portion 77C and the position of the center of the drum 62 on a transverse cross section Xc-Yc before adjusting the relative position of the drum 62 with respect to the rubber blade leading end portion 77C. FIG. 20B is a longitudinal cross sectional view passing through the drum bearing adjustment hole 73E and the drum bearing fixing shaft 71D in the state of FIG. 20A. Incidentally, the drum bearing adjustment hole 78B and the drum bearing fixing shaft 71E on the non-driving side also have the same configuration as that of FIG. 20B, and hence, will not be described herein. FIG. 1A is a transverse cross sectional view for illustrating the adjustment amount of the drum 62 during the relative position adjustment of the drum 62. FIG. 1B is a longitudinal cross sectional view passing through the drum bearing adjustment hole 73E and the drum bearing fixing shaft 71D in the state of FIG. 1A. Incidentally, the drum bearing adjustment hole 78B and the drum bearing fixing shaft 71E on the non-driving side also have the same configuration as that of FIG. 1B, and hence will not be described herein. FIG. 21A is a transverse cross sectional view for illustrating the relative positions of the rubber blade leading end portion 77C and the drum 62 after adjusting the relative position of the drum 62. FIG. 21B is a longitudinal cross sectional view passing through the drum bearing adjustment hole 73E and the drum bearing fixing shaft 71D in the state of FIG. 21A. Incidentally, the drum bearing adjustment hole 78B and the drum bearing fixing shaft 71E on the non-driving side also have the same configuration as that of FIG. 21B, and hence will not be described herein. FIG. 21C is an enlarged cross sectional view for illustrating the relative inroad amount between the rubber blade leading end portion 77C and the drum outer peripheral surface 62A in FIG. 21A.

The drum bearing fourth step is a step (adjusting step) of adjusting the relative position of the drum bearing with respect to the cleaning frame 71 in the crossing direction crossing the rotational axial direction of the drum 62 as illustrated in FIG. 14. The crossing direction crossing the rotational axial direction of the drum 62 is the transverse direction of the drum 62 (the direction orthogonal to the longitudinal direction). In the drum bearing fourth step, the relative position of the drum bearing with respect to the cleaning frame 71 is adjusted so that the inroad amount of the rubber blade leading end portion 77C with respect to the drum outer peripheral surface 62A falls within a predetermined range. For example, as illustrated in FIG. 21C, the position of the drum bearing is adjusted with respect to the cleaning frame 71 so that a relative inroad amount ($\Delta CX$, $\Delta CY$) between the rubber blade leading end portion 77C and the drum outer peripheral surface 62A falls within a predetermined range. In the drum bearing fourth step, first, coordinates of the rotational axis [$X_{drs}$, $Y_{drs}$] of the drum 62 from the reference position 0 on the transverse cross section Xc-Yc is measured by a drum central position measuring apparatus (not illustrated). As the drum central position measuring apparatus, an optical microscope, a dial gauge, a laser displacement gauge, or the like is used. Before adjusting the relative position of the drum 62 with respect to the rubber blade leading end portion 77C, as illustrated in FIG. 20B, an adjusting clearance $\Delta C$ is provided between the drum bearing adjustment hole 73E and the drum bearing fixing shaft 71D.

As illustrated in FIG. 21C, the relative inroad amount ($\Delta CX$, $\Delta CY$) between the rubber blade leading end portion 77C and the drum outer peripheral surface 62A is set at a predetermined value in view of the cleaning performance of the untransferred toner on the drum outer peripheral surface 62A, and the driving torque of the drum 62. The relative positions of the rubber blade leading end portion 77C and the rotational center of the drum 62 when the relative inroad amount ($\Delta CX$, $\Delta CY$) becomes a predetermined value is expressed by the objective relative position [$\Delta X_{ce}$, $\Delta Y_{ce}$] as illustrated in FIG. 21A. In the drum bearing fourth step, the position on the transverse cross section Xc-Yc of the drum bearing is adjusted so that the relative positions of the rubber blade leading end portion 77C and the drum 62 become the objective relative position [$\Delta X_{ce}$, $\Delta Y_{ce}$]. Specifically, the position of the drum bearing on the transverse cross section Xc-Yc is adjusted by the adjustment amount expressed as [$X_{dre}-X_{drs}$, $Y_{dre}-Y_{drs}$] with respect to the drum 62 at the coordinates of the rotational axis [$X_{drs}$, $Y_{drs}$] before adjustment as illustrated in FIG. 1A. In the state in which the position of the drum bearing is adjusted by the adjustment amount [$X_{dre}-X_{drs}$, $Y_{dre}-Y_{drs}$], as illustrated in FIG. 21B, the minimum clearance between the drum bearing and the cleaning frame 71 is reduced to ΔC−ΔTe. Herein, ΔTe is the absolute value of the adjustment amount [$X_{dre}-X_{drs}$, $Y_{dre}-Y_{drs}$], and the movement amount before and after adjustment of the drum bearing expressed as the following equation 1.

$$\Delta Te=\sqrt{(X_{dre}-X_{drs})^2+(Y_{dre}-Y_{drs})^2} \quad \text{(Equation 1)}$$

A larger adjusting clearance ΔC with respect to the processing tolerance of the component is previously ensured. As a result, the post-adjustment minimum clearance ΔC−ΔTe is 0 or more. For this reason, it is possible to prevent the interference between the drum bearing and the cleaning frame 71 after adjustment.

Figure 22A:
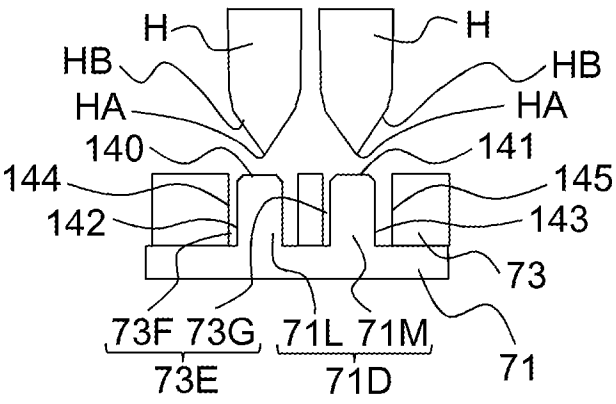
FIGS. 22A to 22D are each a cross sectional view for illustrating a drum bearing fifth step in First Embodiment.
Figure 22B:
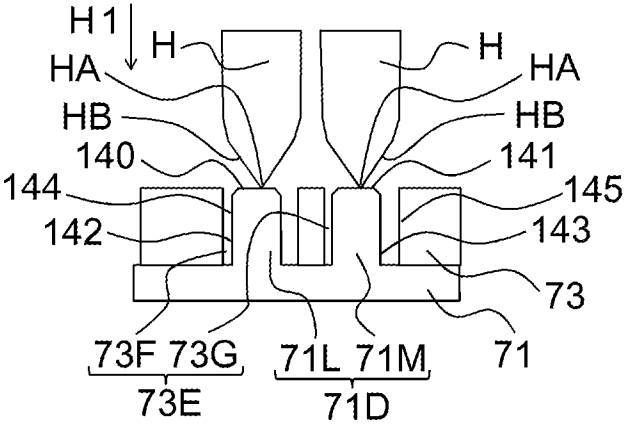
Figure 22C:
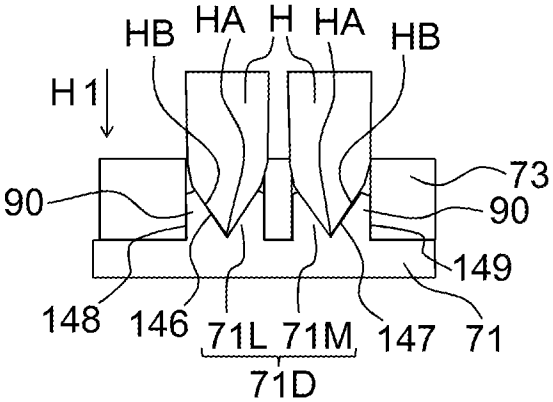
Figure 22D:
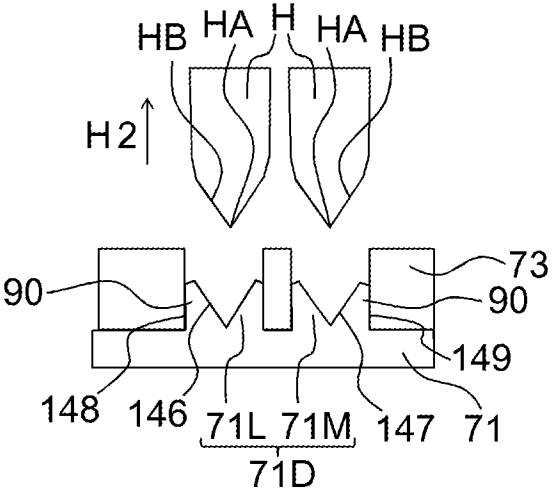

The drum bearing fifth step will be described by reference to FIGS. 14, 22A, 22B, 22C, and 22D. FIG. 22A is a longitudinal cross sectional view passing through the drum bearing adjustment hole 73E and the drum bearing fixing shaft 71D after adjustment of the relative position of the drum 62 with respect to the rubber blade leading end portion 77C. Incidentally, the drum bearing adjustment hole 78B and the drum bearing fixing shaft 71E on the non-driving side also have the same configuration as that of FIG. 22A, and hence will not be described herein. FIG. 22B is a longitudinal cross sectional view for illustrating the state in which ultrasonic spot welding horns H are inserted to the drum bearing adjustment hole 73E and the drum bearing fixing shaft 71D of FIG. 22A. Herein, the welding method by ultrasonic spot welding will be described. The ultrasonic spot welding is one of methods for welding two members using an ultrasonic wave. For ultrasonic welding, an oscillation apparatus for generating ultrasonic vibration, and a resonator attached to the oscillation apparatus, and for transmitting ultrasonic vibration to the member are used. In the present Embodiment, the ultrasonic spot welding horn H corresponds to the resonator. The ultrasonic spot welding horn H applies a given pressure to the members, and applies ultrasonic vibration thereto. This causes frictional heat between the resins of the two members. The frictional heat melts the resins, then, the melted portion is cooled and solidified. As a result, the two members are welded. The materials for the members to be welded by ultrasonic welding desirably include a thermoplastic resin. Further, in order to enhance the welding strength of the two members, the materials for the two members preferably have compatibility with each other at least at the melted portion. More desirably, the materials having the highest content of the two members are the same. FIG. 22C is a longitudinal cross sectional view for illustrating the manner in which the drum bearing fixing shaft 71D is melted by the vibration of the ultrasonic spot welding horn H of FIG. 22B. FIG. 22D is a longitudinal cross sectional view for illustrating the state in which the ultrasonic spot welding horns H of FIG. 22C have been retracted from the drum bearing fixing shaft 71D.

The drum bearing fifth step is a step (welding step) of subjecting the drum bearing and the cleaning frame 71 to ultrasonic spot welding with the relative positions of the rubber blade leading end portion 77C and the drum 62 adjusted as illustrated in FIG. 14. In the drum bearing fifth step, as the welding means for the drum bearing and the cleaning frame 71, the ultrasonic spot welding horns H illustrated in FIG. 22A are used. The ultrasonic spot welding horn H is an oscillator (resonator for transmitting vibration from an oscillation apparatus) made of a titanium alloy or an aluminum alloy vibrating within the ultrasonic range. Incidentally, herein, an example in which using an ultrasonic spot welding, the drum bearing and the cleaning frame 71 are welded is illustrated. However, using other welding methods, the drum bearing and the cleaning frame 71 may be welded.

As illustrated in FIG. 22A, each ultrasonic spot welding horn H is provided with a cylindrical part, and a horn tapered part HB decreasing in diameter from the cylindrical part toward the horn leading end portion HA. In other words, in the ultrasonic spot welding horn H, the horn tip part HA has a pointed shape. By using the ultrasonic spot welding horn H having such a tip shape, it is possible to weld the members without forming a projection shape (so-called ultrasonic joint) for transmitting an ultrasonic wave to the members to be welded. The horn leading end portions HA face a top surface 140 and a top surface 141 which are the longitudinal end faces of the drum bearing fixing shaft 71D, respectively. During welding of the drum bearing and the cleaning frame 71, as illustrated in FIG. 22B, the ultrasonic spot welding horns H move into the horn penetration direction H1. As a result, the horn leading end portions HA come in contact with the top surfaces 140 and 141, respectively. At this step, the ultrasonic spot welding horns H apply a predetermined load to the top surfaces 140 and 141 in the horn penetration direction H1. The ultrasonic spot welding horns H vibrate while applying a predetermined load, thereby to apply an ultrasonic wave from the horn leading end portions HA to the top surfaces 140 and 141.

The top surfaces 140 and 141 applied with an ultrasonic wave are heated by the vibration of each horn leading end portion HA as illustrated in FIG. 22C. The heating melts the drum bearing fixing shaft 71D, and the melted resin flows through between the drum bearing fixing shaft 71D and the inner peripheral surface of the drum bearing adjustment hole 73E. Therefore, as illustrated in FIG. 22C, in the crossing direction crossing the rotational axial direction of the drum 62, a melted portion 90 is formed between the inner peripheral surface of the drum bearing adjustment hole 73E and the drum bearing fixing shaft 71D. The rotational axial direction of the drum 62 is in agreement with the axial direction of the drum bearing fixing shaft 71D. The crossing direction crossing the rotational axial direction of the drum 62 is in agreement with the crossing direction crossing the axial direction of the drum bearing fixing shaft 71D. Further, the drum bearing fixing shaft 71D is melted, thereby to form melted top surfaces 146 and 147 to each of which the shape of each horn tapered part HB has been transferred. The first drum bearing fixing shaft 71L is melted, so that the outer peripheral surface 142 of a first drum bearing fixing shaft 71L is welded with the inner peripheral surface 144 of the first drum bearing adjustment hole 73F, resulting in the formation of a welded surface 148. The second drum bearing fixing shaft 71M is melted, so that the outer peripheral surface 143 of a second drum bearing fixing shaft 71M is welded with the inner peripheral surface 145 of a second drum bearing adjustment hole 73G, resulting in the formation of a welded surface 149.

In the above description, there is illustrated the example in which the drum bearing fixing shaft 71D is melted, thereby to form the melted portion 90 between the inner peripheral surface of the drum bearing adjustment hole 73E and the drum bearing fixing shaft 71D. Not limited to this example, the following is also acceptable: the driving side drum bearing 73 in the vicinity of the drum bearing adjustment hole 73E is melted, so that the melted portion 90 is formed between the drum bearing adjustment hole 73E and the inner peripheral surface of the drum bearing fixing shaft 71D. Alternatively, the following is also acceptable: the drum bearing fixing shaft 71D is melted, and the driving side drum bearing 73 in the vicinity of the drum bearing adjustment hole 73E is melted, so that the melted portion 90 is formed between the drum bearing adjustment hole 73E and the inner peripheral surface of the drum bearing fixing shaft 71D.

Then, in order to stop the vibration of each ultrasonic spot welding horn H, and to cool and solidify the melted top surfaces 146 and 147, the ultrasonic spot welding horn H is allowed to stand still for one or two seconds. The ultrasonic spot welding horn H after standing still moves in a horn retraction direction H2 as illustrated in FIG. 22D. From the description up to this point, the welded surfaces 148 and 149 are cooled and solidified. Accordingly, the drum bearing and the cleaning frame 71 are firmly welded.

As described up to this point, in accordance with Embodiment 1, by the assembly step of FIG. 14, the drum bearing is adjusted and assembled to the cleaning frame 71, and further, by the ultrasonic spot welding horns H, the drum bearing and the cleaning frame 71 are welded. Therefore, it is possible to provide an assembly method of the cartridge B capable of suppressing the relative positional variation of the drum 62 and the cleaning blade 77 caused by the processing error of the components, and the assembly error due to a twisting torque upon screw fastening.

In accordance with Embodiment 1, the clearance between the drum bearing fixing shaft 71D and the driving side drum bearing 73 is filled with the melted portion 90. This suppresses the displacement of the relative positions of the cleaning frame 71 and the driving side drum bearing 73 after welding the cleaning frame 71 and the driving side drum bearing 73. Therefore, the effect of suppressing the relative positional variation of the drum 62 and the cleaning blade 77 after adjusting the relative position of the driving side drum bearing 73 with respect to the cleaning frame 71 is enhanced.

In Embodiment 1, in order to adjust the relative inroad amount ($\Delta CX$, $\Delta CY$) between the rubber blade leading end portion 77C and the drum outer peripheral surface 62A, the drum 62 is used as a rotating member, the cleaning blade 77 is used as a blade member and the cleaning frame 71 is used as a frame. Whereas, the driving side drum bearing 73 and the non-driving side drum bearing 78 are used as bearing members. On the other hand, the development roller 32 may be used as a rotating member, the development blade 42 may be used as a blade member and the developer container 23 may be used as a frame, and the driving side development roller bearing 27 and the non-driving side development roller bearing 37 may be used as bearing members. In this case, it is possible to provide an assembly method of the cartridge B capable of suppressing the relative positional variation of the development roller 32 and the development blade 42 in the same step as that of FIG. 14.

In the same step as the drum bearing fourth step, the relative positions of the driving side development roller bearing 27 and the non-driving side development roller bearing 37 with respect to the developer container 23 may be adjusted in the following manner. The relative positions of the driving side development roller bearing 27 and the non-driving side development roller bearing 37 with respect to the developer container 23 may be adjusted so that the distance between the development roller outer peripheral surface 32A and the leading end portion of the development blade 42 falls within a predetermined range. Alternatively, relative positions of the driving side development roller bearing 27 and the non-driving side development roller bearing 37 with respect to the developer container 23 may be adjusted so that the inroad amount of the leading end portion of the development blade 42 with respect to the development roller outer peripheral surface 32A falls within a predetermined range.

Incidentally, for the functions, materials, shapes, and relative arrangement of the constituent components described in Embodiment 1, and the like, the scope of this invention is construed as not being only limited thereto unless otherwise specified.

Embodiment 2

Then, by reference to FIGS. 23A, 23B, 23C, and 23D, Second Embodiment in accordance with the present invention will be described. Incidentally, in Embodiment 2, a different part from that of Embodiment 1 will be described in details. Unless otherwise specified, the materials, shapes, and the like are the same as those in Embodiment 1. Such portions are given the same number, and will not be described in details.

Figure 23A:
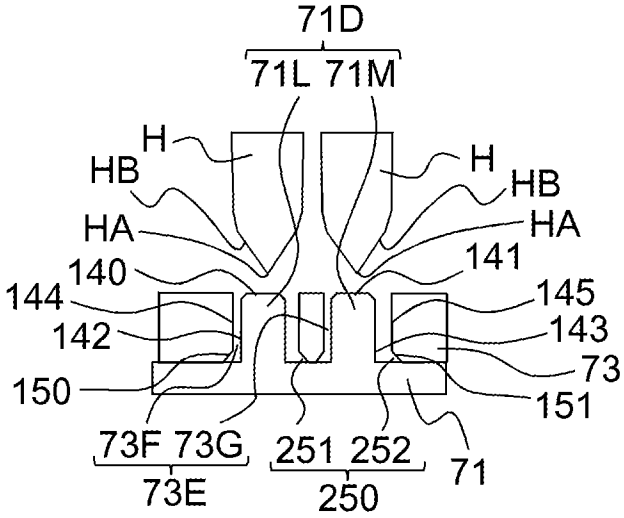
FIGS. 23A to 23D are each a cross sectional view for illustrating the drum bearing fifth step in Second Embodiment.
Figure 23B:
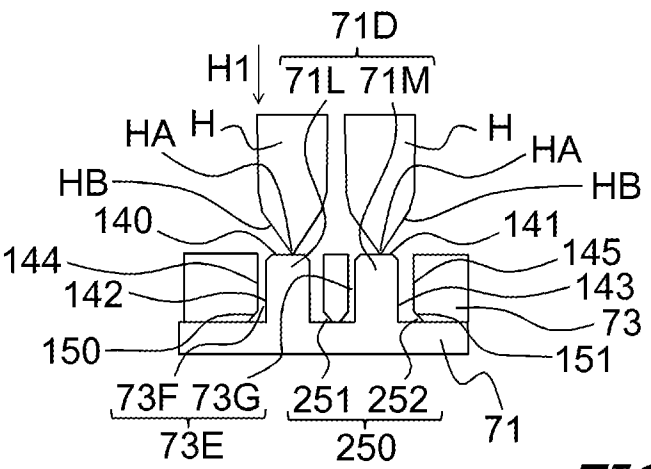
Figure 23C:
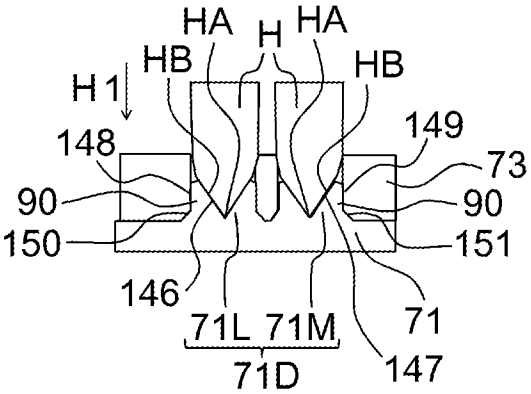
Figure 23D:
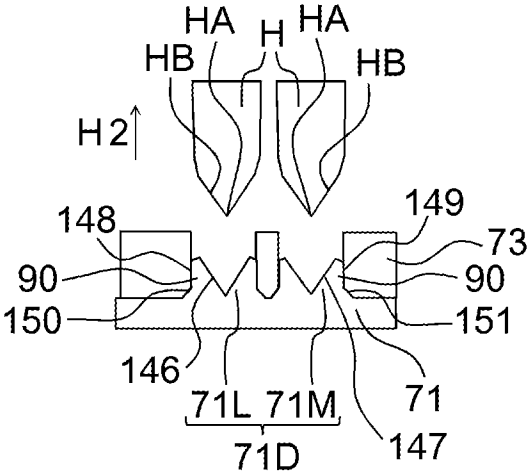

FIG. 23A is a longitudinal cross sectional view passing through the drum bearing adjustment hole 73E and the drum bearing fixing shaft 71D in the drum bearing fifth step. Incidentally, the non-driving side drum bearing adjustment hole (not illustrated) and the non-driving side drum bearing fixed shaft (not illustrated) on the non-driving side also have the same configuration as that of FIG. 23A, and hence herein will not be described. FIG. 23B is a longitudinal cross sectional view for illustrating the state in which the ultrasonic spot welding horns H penetrate into the drum bearing adjustment hole 73E and the drum bearing fixing shaft 71D of FIG. 23A, respectively. FIG. 23C is a longitudinal cross sectional view for illustrating the manner in which the drum bearing fixing shaft 71D is melted by the vibration of the ultrasonic spot welding horns H of FIG. 23B. FIG. 23D is a longitudinal cross sectional view for illustrating the manner in which the ultrasonic spot welding horns H of FIG. 23C have been retracted from the drum bearing fixing shaft 71D.

As illustrated in FIG. 23A, the inner peripheral surface 144 of the first drum bearing adjustment hole 73F on the driving side has a tapered surface 150 expanding toward the outside of the first drum bearing adjustment hole 73F in the crossing direction crossing the rotational axial direction of the drum 62. Whereas, as illustrated in FIG. 23A, the inner peripheral surface 145 of the second drum bearing adjustment hole 73G on the driving side has a tapered surface 151 expanding toward the outside of the second drum bearing adjustment hole 73G in the crossing direction crossing the rotational axial direction of the drum 62. Therefore, as illustrated in FIG. 23A, at the root of the drum bearing adjustment hole 73E (the first drum bearing adjustment hole 73F and the second drum bearing adjustment hole 73G), a void (vacant space) 250 (a first void 251 and a second void 252) is provided. When the drum bearing fixing shaft 71D is fitted with the drum bearing adjustment hole 73E, the first void 251 is formed between the tapered surface 150 and the first drum bearing fixing shaft 71L. Whereas, when the drum bearing fixing shaft 71D is fitted with the drum bearing adjustment hole 73E, the second void 252 is formed between the tapered surface 151 and the second drum bearing fixing shaft 71M.

For welding the drum bearing and the cleaning frame 71, as illustrated in FIG. 23B, the ultrasonic spot welding horns H are moved in the horn penetration direction H1. As a result, the horn leading end portions HA come in contact with the top surfaces 140 and 141, respectively. The ultrasonic spot welding horns H vibrate while applying a predetermined load in the horn penetration direction H1 as with Embodiment 1, thereby to apply an ultrasonic wave from the horn leading end portion HA to the top surfaces 140 and 141.

The top surfaces 140 and 141 applied with an ultrasonic wave are heated by the vibration of the horn leading end portion HA as illustrated in FIG. 23C. The heating melts the drum bearing fixing shaft 71D, and the melted resin flows between the drum bearing fixing shaft 71D and the inner peripheral surface of the drum bearing adjustment hole 73E. Therefore, as with Embodiment 1, in the crossing direction crossing the rotational axial direction of the drum 62, a melted portion 90 is formed between the inner peripheral surfaces of the drum bearing adjustment hole 73E and the drum bearing fixing shaft 71D. The drum bearing fixing shaft 71D is melted, thereby to form melted top surfaces 146 and 147 as with Embodiment 1. Further, welded surfaces 148 and 149 are formed as with Embodiment 1. In addition, the drum bearing fixing shaft 71D is melted, so that the melted resin flows into the void 250. This results in the formation of the melted portion 90 in the whole part or a part of the void 250.

As with Embodiment 1, the following is also acceptable: the driving side drum bearing 73 in the vicinity of the drum bearing adjustment hole 73E is melted, so that the melted portion 90 is formed between the inner peripheral surface of the drum bearing adjustment hole 73E and the drum bearing fixing shaft 71D. Alternatively, the following is also acceptable: the driving side drum bearing 73 in the vicinity of the drum bearing adjustment hole 73E is melted, so that the melted portion 90 is formed in the whole part or a part of the void 250. As with Embodiment 1, the following is also acceptable: the drum bearing fixing shaft 71D and the driving side drum bearing 73 in the vicinity of the drum bearing adjustment hole 73E are melted, so that the melted portion 90 is formed between the inner peripheral surfaces of the drum bearing adjustment hole 73E and the drum bearing fixing shaft 71D. Alternatively, the drum bearing fixing shaft 71D is melted, and the driving side drum bearing 73 in the vicinity of the drum bearing adjustment hole 73E are melted, so that the melted portion 90 is formed at the whole part or a part of the void 250.

Then, each ultrasonic spot welding horn H is stopped vibrating, is allowed to stand still for 1 or 2 seconds, and is moved in the horn retraction direction H2, as with Embodiment 1. From the description up to this point, the welded surfaces 148 and 149 are cooled and solidified, so that the drum bearing and the cleaning frame 71 are firmly welded.

As described up to this point, in accordance with Embodiment 2, the driving side drum bearing 73 is provided with the void 250. Accordingly, even when a variation is caused in inroad amount of the ultrasonic spot welding horn H by the processing error of the drum bearing fixing shaft 71D, the melted resin flows into the void 250. For this reason, welding can be achieved without overflowing of the melted resin outwardly of the driving side drum bearing 73. Further, the void 250 is formed around the drum bearing fixing shaft 71D, and hence the melted portion 90 becomes more likely to go around drum bearing fixing shaft 71D. Accordingly, the drum bearing and the cleaning frame 71 are more firmly welded.

In accordance with Embodiment 2, the clearance between the drum bearing fixing shaft 71D and the driving side drum bearing 73 is filled with the melted portion 90. This suppresses the displacement of the relative positions of the cleaning frame 71 and the driving side drum bearing 73 after welding the cleaning frame 71 and the driving side drum bearing 73. Therefore, the effect of suppressing the relative positional variation of the drum 62 and the cleaning blade 77 after adjusting the relative position of the driving side drum bearing 73 with respect to the cleaning frame 71 is enhanced.

In Embodiment 2, in order to adjust the relative inroad amount ($\Delta CX$, $\Delta CY$) of the rubber blade leading end portion 77C and the drum outer peripheral surface 62A, the drum 62 is used as a rotating member, the cleaning blade 77 is used as a blade member and the cleaning frame 71 is used as a frame. Whereas, the driving side drum bearing 73 and the non-driving side drum bearing 78 are used as bearing members. On the other hand, the development roller 32 may be used as a rotating member, the development blade 42 may be used as a blade member, the developer container 23 may be used as a frame, and the driving side development roller bearing 27 and the non-driving side development roller bearing 37 may be used as bearing members. In this case, it is possible to provide an assembly method of the cartridge B capable of suppressing the relative positional variation of the development roller 32 and development blade 42 in the same step as that of FIG. 14.

Incidentally, for the functions, materials, shapes, and relative arrangement of the constituent components described in Embodiment 2, and the like, the scope of this invention is construed as not being only limited thereto unless otherwise specified.

Embodiment 3

Figure 24:
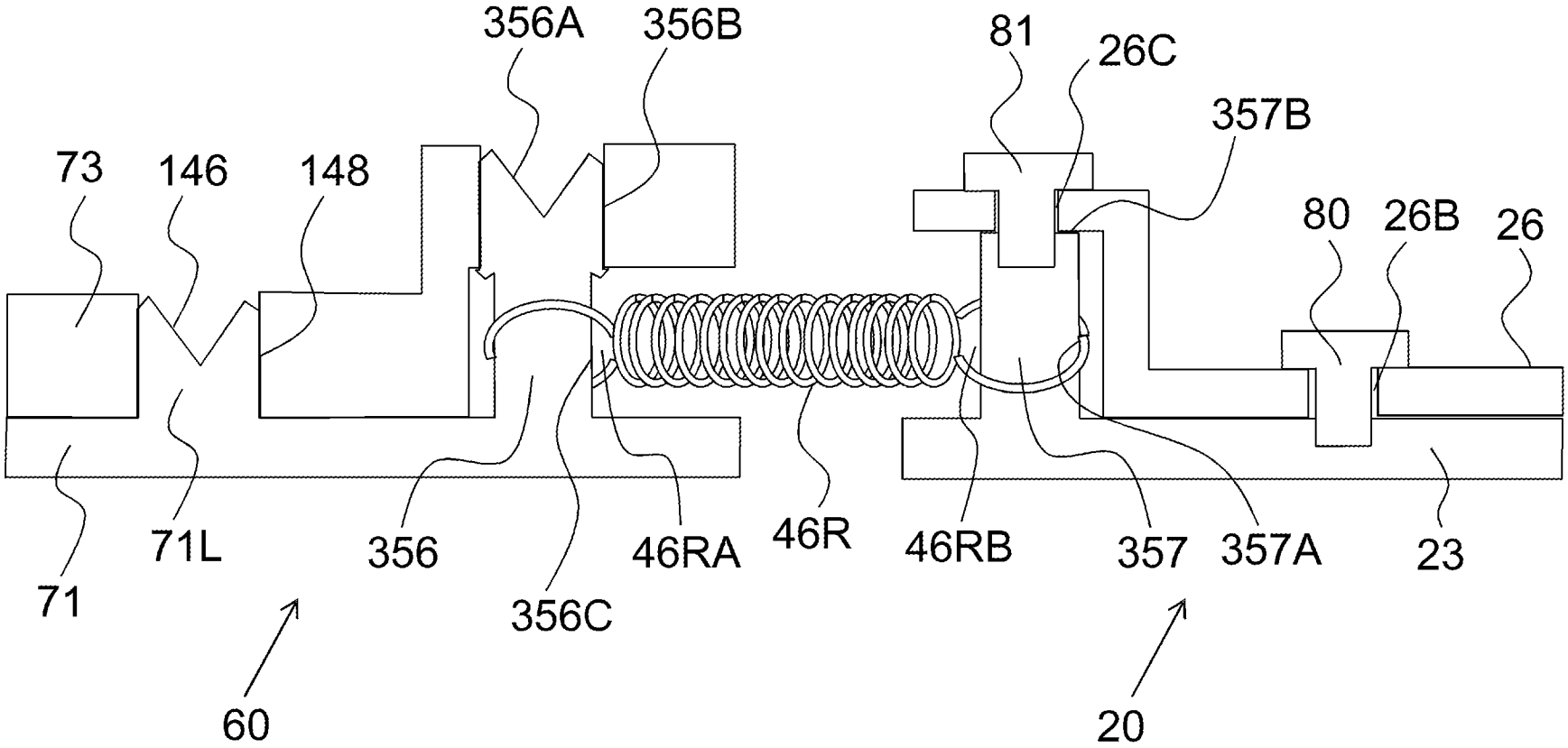
FIG. 24 is a cross sectional view for illustrating a drum bearing fifth step in Third Embodiment.

Then, by reference to FIG. 24, Embodiment 3 in accordance with the present invention will be described. Incidentally, in Embodiment 3, a difference from Embodiments 1 and 2 will be described in details. Unless otherwise specified, the materials, shapes, and the like are the same as those in Embodiments 1 and 2. Such portions are given the same number, and will not be described in details. FIG. 24 is a longitudinal cross sectional view for illustrating a double-support configuration of the driving side urging member 46R. The driving side urging member 46R urges the cleaning frame 71 to the developer container 23.

As illustrated in FIG. 24, the cleaning frame 71 is provided with a first support shaft 356 in addition to the first drum bearing fixing shaft 71L. The first support shaft 356 is one example of a first adjustment shaft and a first shaft part. The first support shaft 356 includes a melted top surface 356A, a welded surface 356B, and a spring hook surface 356C. The melted top surface 356A has a shape transferred by the horn leading end portion HA during welding by the ultrasonic spot welding horn H as with the melted top surface 146. Whereas, the welded surface 356B is formed by welding by the ultrasonic spot welding horn H as with the welded surface 148. The welded surface 356B is welded to the driving side drum bearing 73. The spring hook surface 356C is formed at the root of the first support shaft 356. The first hole 46RA of the driving side urging member 46R is hooked to the spring hook surface 356C.

On the other hand, the development side member 26 on the driving side is provided with a first screw hole 26B and a second screw hole 26C. The development side member 26 is fixed to the developer container 23 by fastening a first fixing screw 80 and a second fixing screw 81 to the developer container 23 via the first screw hole 26B and the second screw hole 26C, respectively. As the fixing means for the development side member 26 and the developer container 23, the first fixing screw 80 and the second fixing screw 81 are used in Embodiment 3. However, as another fixing means, resin welding or ultrasonic spot welding may be used. Further, a second support shaft 357 is provided on the driving side of the developer container 23. The second support shaft 357 includes a spring hook surface 357A and a screw seat 357B. The spring hook surface 357A is formed at the root of the second support shaft 357. A second hole 46RB of the driving side urging member 46R is hooked to the spring hook surface 357A.

The first support shaft 356 is a cantilevered support shaft extending from the cleaning frame 71 before ultrasonic spot welding, and becomes a double supported support shaft due to the formation of the welded surface 356B after ultrasonic spot welding. In addition, the second support shaft 357 is a cantilevered support shaft extending from the developer container 23 before screw fastening. However, after screw fastening, the screw seat 357B is fastened with the development side member 26 by the second fixing screw 81, resulting in a double supported support shaft.

This enables the suppression of the flexure due to the urging force from the driving side urging member 46R of the first support shaft 356 and the second support shaft 357 against the cantilevered state. By suppressing the flexure amount, it is possible to suppress the loss of the urging force of the development unit 20 against the cleaning unit 60. For this reason, it becomes possible to press the development roller 32 in the direction of the drum 62 with more reliability.

After attaching the driving side urging member 46R to the first support shaft 356, ultrasonic spot welding is performed. The first support shaft 356 has the welded surface 356B welded to the driving side drum bearing 73, and the spring hook surface 356C not welded to the driving side drum bearing 73. The welded surface 356B is one example of the first portion. The spring hook surface 356C is one example of the second portion. The first hole 46RA of the driving side urging member 46R is hooked to the spring hook surface 356C, thereby to attach the first end of the driving side urging member 46R to the spring hook surface 356C. The second hole 46RB of the driving side urging member 46R is hooked to the spring hook surface 357A, thereby to attach the second end of the driving side urging member 46R to the developer container 23. The welded surface 356B is welded to the driving side drum bearing 73. This regulates falling off of the first end of the driving side urging member 46R from the spring hook surface 356C. In accordance with Embodiment 3, the relative positional variation of the drum 62 and the cleaning blade 77 can be suppressed, and the falling off of the driving side urging member 46R from the first support shaft 356 can be suppressed.

In Embodiment 3, a description has been given by reference to the double-support configuration of the driving side urging member 46R provided on the driving side of the cartridge B. The non-driving side urging member 46F provided on the non-driving side is also supported by the same double-support configuration. This enables the development roller 32 to be pressed in the direction of the drum 62 with more reliability.

Incidentally, for the functions, materials, shapes, and relative arrangement of the constituent components described in Embodiment 3, and the like, the scope of this invention is construed as not being only limited thereto unless otherwise specified.

Embodiment 4

Figure 25:
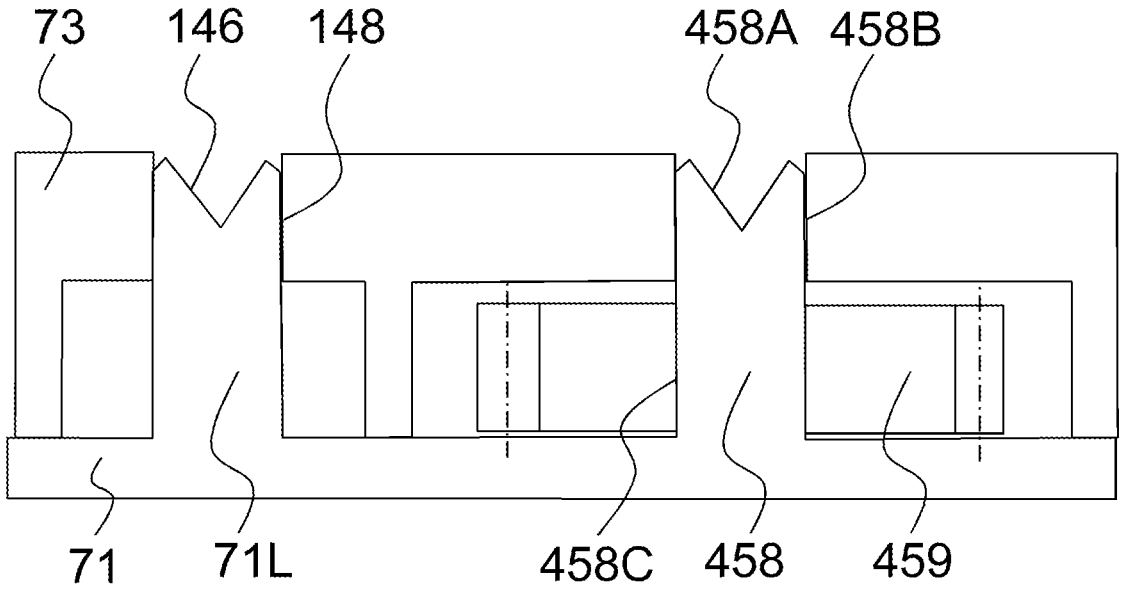
FIG. 25 is a cross sectional view for illustrating a drum bearing fifth step in Fourth Embodiment.

Then, by reference to FIG. 25, Embodiment 4 in accordance with the present invention will be described. Incidentally, in Embodiment 4, a difference from Embodiments 1 to 3 will be described in details. Unless otherwise specified, the materials, shapes, and the like are the same as those of Embodiments 1 to 3. Such portions are Liven the same number, and will not be described in details. FIG. 25 is a longitudinal cross sectional view for illustrating the double-support configuration of a double support gear 459 by the driving side drum bearing 73 and the cleaning frame 71.

As illustrated in FIG. 25, the cleaning frame 71 is provided with a gear support shaft 458 in addition to the first drum bearing fixing shaft 71L. The gear support shaft 458 is one example of the second adjustment shaft and the second shaft part. The gear support shaft 458 includes a melted top surface 458A, a welded surface 458B, and a gear support surface 458C. The melted top surface 458A has a shape transferred by the horn leading end portion HA during welding by the ultrasonic spot welding horn H as with the melted top surface 146. Whereas, the welded surface 458B is formed by welding by the ultrasonic spot welding horn H as with the welded surface 148. The welded surface 458B is welded to the driving side drum bearing 73. The gear support surface 458C is formed at the root of the gear support shaft 458. The double support gear 459 in Embodiment 4 is a screw driving input gear for transmitting a rotary driving force to a first screw gear (not illustrated) as a rotary driving means of the first screw 86 illustrated in FIGS. 4A and 4B, and is pivotally supported rotatably by the gear support surface 458C.

The gear support shaft 458 is a cantilevered support shaft extending from the cleaning frame 71 before ultrasonic spot welding, but becomes a double support shaft due to the formation of the welded surface 458B after ultrasonic spot welding. This enables suppression of the flexure of the gear support shaft 458 due to the rotary driving torque when the double support gear 459 rotationally drives the first screw gear against the cantilevered state. By suppressing the flexure amount, it is possible to prevent tooth jumping between the double support gear 459 and the first screw gear. For this reason, it becomes possible to convey the waste toner by the first screw 86, the second screw 87, and the third screw 88 provided in the cleaning unit 60 with more reliability.

After attachment of the double support gear 459 to the gear support shaft 458, ultrasonic spot welding is performed. The gear support shaft 458 has the welded surface 458B welded to the driving side drum bearing 73, and the gear support surface 458C not welded to the driving side drum bearing 73. The welded surface 458B is one example of the third portion. The gear support surface 458C is one example of the fourth portion. The double support gear 459 is attached to the gear support surface 458C. The welded surface 458B is welded to the driving side drum bearing 73, which regulates falling off of the double support gear 459 from the gear support surface 458C. In accordance with Embodiment 4, the relative positional variation of the drum 62 and the cleaning blade 77 can be suppressed, and the double support gear 459 can be suppressed from falling off from the gear support shaft 458.

In Embodiment 4, the double support gear 459 is applied as the screw driving input gear provided at the cleaning unit 60. Not limited thereto, the double support gear 459 can also be used as a conveyance member driving gear for rotationally driving the first conveying member 43, the second conveying member 44, and the third conveying member 50 provided at the development unit 20. Also in this case, it becomes possible to prevent tooth jumping of the double support gear 459. For this reason, it becomes possible to convey the toner T in the toner chamber 29 to the toner supply chamber 28 with more reliability.

Incidentally, for the functions, materials, shapes, and relative arrangement of the constituent components described in Embodiment 4, and the like, the scope of this invention is construed as not being only limited thereto unless otherwise specified.

In accordance with the present invention, it is possible to suppress the relative positional variation of the photosensitive drum and the cleaning blade, and the relative positional variation of the development roller and the development blade caused by the processing error of the components and the assembly error due to a twisting torque upon screw fastening.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions. This application claims the benefit of Japanese Patent Application No. 2018-60013, filed Mar. 27, 2018, which is hereby incorporated by reference herein in its entirety.

What is claimed is:

1. A manufacturing method of a cartridge, the cartridge including a frame; a blade member including a leading end portion and fixed to the frame; a rotating member including a surface facing the leading end portion; and a bearing member for supporting the rotating member, the manufacturing method comprising:

attaching the rotating member to the bearing member;

fitting an adjustment shaft provided at the frame with an adjustment hole provided at the bearing member;

adjusting a relative position of the bearing member with respect to the frame in a crossing direction crossing a rotational axial direction of the rotating member; and welding the frame and the bearing member after the adjusting, wherein at least one of the frame or the bearing member is melted such that a melted portion is formed between an inner peripheral surface of the adjustment hole and the adjustment shaft in the crossing direction.

2. The manufacturing method of the cartridge according to claim 1, wherein the inner peripheral surface includes a tapered surface expanding toward an outside of the adjustment hole in the crossing direction, when the adjustment shaft is fitted with the adjustment hole, a vacant space is formed between the tapered surface and the adjustment shaft, and the melted portion is formed at least a part of the vacant space.

3. The manufacturing method of the cartridge according to claim 1 wherein the frame includes a plurality of the adjustment shafts, and the bearing member is provided with a plurality of the adjustment holes.

4. The manufacturing method of the cartridge according to claim 1, wherein the cartridge includes an urging member for urging the frame to another frame, the frame includes a first supporting shaft including a first portion and a second portion, and the manufacturing method comprises:

attaching a first end of the urging member to the second portion;

attaching a second end of the urging member to the another frame; and welding the first portion to the bearing member such that the second portion is not welded to the bearing member.

5. The manufacturing method of the cartridge according to claim 1, wherein a difference between a diameter of the adjustment hole and a diameter of the adjustment shaft is 0.2 mm or more and 1.6 mm or less.

6. The manufacturing method of the cartridge according to claim 1, wherein the rotating member is an image bearing member for forming an electrostatic latent image thereon, and the blade member is a cleaning member for cleaning a developer on the image bearing member.

7. The manufacturing method of the cartridge according to claim 6, wherein in the adjusting, the relative position of the bearing member with respect to the frame is adjusted such that an inroad amount of a leading end portion of the cleaning member to a surface of the image bearing member falls within a predetermined range.

8. The manufacturing method of the cartridge according to claim 6, wherein the cartridge includes a conveying member configured to convey a removed substance removed from the image bearing member by the cleaning member toward an accommodation portion, and a driving gear for rotationally driving the conveying member, the frame includes a second supporting shaft, the second supporting shaft includes a third portion and a fourth portion, wherein the manufacturing method comprises:

attaching the driving gear to the fourth portion, and welding the third portion to the bearing member such that the fourth portion is not welded to the bearing member.

9. The manufacturing method of the cartridge according to claim 1, wherein the rotating member is a developer bearing member configured to bear a developer, and the blade member is a thickness regulating member for regulating a thickness of the developer borne by the developer bearing member.

10. The manufacturing method of the cartridge according to claim 9, wherein in the adjusting, the relative position of the bearing member with respect to the frame is adjusted such that a distance between a surface of the developer bearing member and a leading end portion of the thickness regulating member falls within a predetermined range.

11. The manufacturing method of the cartridge according to claim 9, wherein in the adjusting, the relative position of the bearing member with respect to the frame is adjusted such that an inroad amount of a leading end portion of the thickness regulating member to a surface of the developer bearing member falls within a predetermined range.

12. The manufacturing method of the cartridge according to claim 9, wherein the cartridge includes a conveying member for conveying the developer toward the developer bearing member, and a driving gear for rotationally driving the conveying member, the frame includes a second supporting shaft, the second supporting shaft includes a third portion and a fourth portion, wherein the manufacturing method comprises:

attaching the driving gear to the fourth portion, and welding the third portion to the bearing member such that the fourth portion is not welded to the bearing member.

13. A cartridge, comprising:

a frame including a shaft;

a blade member including a leading end portion and fixed to the frame;

a rotating member including a surface facing the leading end portion of the blade member; and a bearing member for supporting the rotating member, and including a hole to be fitted with the shaft;

wherein the frame and the bearing member are welded such that a melted portion is formed between an inner peripheral surface of the hole and the shaft in a crossing direction crossing a rotational axial direction of the rotating member.

14. The cartridge according to claim 13, wherein the inner peripheral surface includes a tapered surface expanding toward an outside of the hole in the crossing direction, and the melted portion is formed between the tapered surface and the shaft.

15. The cartridge according to claim 13, wherein the frame includes a plurality of the shafts, and the bearing member is provided with a plurality of the holes.

16. The cartridge according to claim 13, further comprising:

an urging member for urging the frame to another frame;

wherein the frame includes a first shaft, the first shaft includes a first portion welded to the bearing member, and a second portion not welded to the bearing member, a first end of the urging member is attached to the second portion, and a second end of the urging member is attached to the another frame.

17. The cartridge according to claim 13, wherein the rotating member is an image bearing member for forming an electrostatic latent image formed thereon, and the blade member is a cleaning member for cleaning a developer on the image bearing member.

18. The cartridge according to claim 17, further comprising:

a conveying member for conveying a removed substance removed from the image bearing member by the cleaning member toward an accommodation portion; and a driving gear for rotationally driving the conveying member, wherein the frame includes a second shaft, and the second shaft includes a third portion welded to the bearing member, and a fourth portion not welded to the bearing member, the driving gear is attached to the fourth portion.

19. The cartridge according to claim 13, wherein the rotating member is a developer bearing member for carrying a developer, and the blade member is a thickness regulating member for regulating a thickness of the developer to be borne by the developer bearing member.

20. The cartridge according to claim 19, further comprising:

a conveying member for conveying the developer toward the developer bearing member; and a driving gear for rotationally driving the conveying member;

wherein the frame includes a second shaft, and the second shaft includes a third portion welded to the bearing member, and a fourth portion not welded to the bearing member, the driving gear is attached to the fourth portion.

* * * * *